US008323084B2

(12) United States Patent
Nagano

(10) Patent No.: US 8,323,084 B2
(45) Date of Patent: Dec. 4, 2012

(54) GAMING MACHINE THAT NAVIGATES DEALER IN GAME ADVANCEMENT

(75) Inventor: Hiroyuki Nagano, Koto-ku (JP)

(73) Assignee: Universal Entertainment Corporation, Tokyo (JP)

( * ) Notice: Subject to any disclaimer, the term of this patent is extended or adjusted under 35 U.S.C. 154(b) by 259 days.

(21) Appl. No.: 12/773,287

(22) Filed: May 4, 2010

(65) Prior Publication Data

US 2010/0291987 A1 Nov. 18, 2010

(30) Foreign Application Priority Data

May 18, 2009 (JP) ..... 2009-120100

(51) Int. Cl.
*A63F 9/24* (2006.01)

(52) U.S. Cl. ..... 463/12; 463/11; 463/13; 463/31

(58) Field of Classification Search ..... 463/11–12, 463/25

See application file for complete search history.

(56) References Cited

U.S. PATENT DOCUMENTS 5,221,083 A * 6/1993 Dote ..... 463/32
5,605,334 A 2/1997 McCrea, Jr.
5,803,808 A 9/1998 Strisower
6,165,069 A * 12/2000 Sines et al. ..... 463/12
6,460,848 B1 * 10/2002 Soltys et al. ..... 273/149 R
7,419,160 B1 9/2008 D'Ambrosio
8,152,617 B2 * 4/2012 Katz ..... 463/13
2003/0195025 A1 * 10/2003 Hill ..... 463/11
2005/0073102 A1 * 4/2005 Yoseloff et al. ..... 273/292
2006/0027970 A1 * 2/2006 Kyrychenko ..... 273/309
2006/0071429 A1 * 4/2006 Okujyo et al. ..... 273/292
2006/0128472 A1 * 6/2006 Beavers ..... 463/42
2008/0220836 A1 * 9/2008 Nagano ..... 463/12
2009/0131151 A1 * 5/2009 Harris et al. ..... 463/22
2009/0264197 A1 * 10/2009 Fujimoto ..... 463/31
2010/0171267 A1 * 7/2010 Walker ..... 273/274
2011/0201400 A1 * 8/2011 Kido et al. ..... 463/16

* cited by examiner

*Primary Examiner* — Melba Bumgarner
*Assistant Examiner* — Lawrence Galka
(74) *Attorney, Agent, or Firm* — Lexyoume IP Meister, PLLC.

(57) ABSTRACT

The present invention provides a gaming system that can allow a game to be appropriately advanced even by an inexperienced dealer by way of navigating the dealer in game advancement, thereby allowing fraud to be avoided and cost to be reduced. A gaming system 1 gives an instruction to a dealer by operating indicators of card placement areas in which a card is to be placed based on a game advancement program. When a card is placed in a predetermined card placement area, the gaming system 1 reads at least one face of the card being placed by image input devices and determines whether the card is placed in a right place and a right orientation and whether the card is appropriate. After that the abovementioned processing is repeated for a predetermined number of times, a score is calculated based on image data and finally a game result is output.

10 Claims, 27 Drawing Sheets

5 SECONDS AFTER BET START

FIRST CARD PLACEMENT WARNING IMAGE

FIRST CARD PLACEMENT WARNING IMAGE

FIRST CARD PLACEMENT WARNING IMAGE

GAMING MACHINE THAT NAVIGATES DEALER IN GAME ADVANCEMENT

CROSS REFERENCE TO RELATED APPLICATIONS

This application is based on and claims the benefit of priority from Japanese Patent Application No. 2009-120100, filed on May 18, 2009, the content of which is incorporated herein by reference.

BACKGROUND OF THE INVENTION

1. Field of the Invention

The present invention relates to a gaming system that navigates a dealer in game advancement.

2. Related Art

Various table games are known conventionally, and among the table games, there exists a game genre called card games.

Among card games, for example, there is a game called baccarat as disclosed in the specification of U.S. Pat. No. 7,419,160 (hereinafter referred to as Patent Document 1). Here, baccarat is a game in which bets are made on any of a "Player (player position)", "Banker (banker position)", and "Tie (draw)" (however, there may be a case in which "Tie" is not a target for betting), which are the bet targets, and awards winnings, based on the bet amount that is bet, to a player having bet on a bet target of a winning side. In addition, in baccarat, cards are distributed to the "player" side and the "banker" side, and winnings are determined based on the cards thus distributed.

Card games such as baccarat are established in casinos, and since a dealer, for casino games, advances the game, it is necessary for the dealer to be proficient in game advancement. However, for countries in which development of casinos has only started, there has been a problem in that there is a shortage of dealers proficient in game advancement.

In addition, a system for advancing a game by reading information embedded in cards used for a card game, by means of an IC chip embedded therein or information printed thereon with special ink, is disclosed in U.S. Pat. No. 5,605,334 (hereinafter referred to as Patent Document 2). In such a system, all cards require the IC chip or printing with the special ink, and therefore a manufacturing cost of the cards becomes high. Cards used in casinos are generally discarded unconditionally after used once or for a predetermined number of times in a game, in order to avoid fraud. This is for avoiding a numeral or a symbol of the card from being distinguished from a reverse face of the card placed face-down due to a flaw or a fold made during use, and for avoiding marking on the card by a malicious player. As a result, with a method of using an IC chip storing data to be read attached to the card, such as sealing an IC tag that can communicate in a contactless manner in the card and the like, a running cost becomes high.

In addition, a system for reading a symbol of a card used for a card game by scanning the card with a card recognition scanner provided on a game field is disclosed in U.S. Pat. No. 5,803,808 (hereinafter referred to as Patent Document 3). In such a case, since cards must be inserted into the card recognition scanner one by one for scanning of the symbol, an inexperienced dealer may show a numeral or a symbol of the card during the operation.

Meanwhile, card games generally have strict rules for order, method, position and the like in the distribution of cards. In addition, the timing and duration of betting are complexly defined for each game. In card games, the dealer's handling of cards based on the numeral and the symbol on the card is naturally important; however, the dealer's behavior before and during the distribution of cards is even more important for determining a result of a game. Although Patent Document 3 discloses an invention of reading a numeral and a symbol of a card and giving an instruction to a dealer based on data being read, the invention cannot be applied to the distribution of cards.

As described above, a dealer is required to strictly act during the distribution of cards, handling of bets, advancement of a game and the like; however, in a situation where the number of experienced dealers is insufficient, there is a need for a system allowing an inexperienced dealer to strictly advance a game.

SUMMARY OF THE INVENTION

The present invention has an object of providing a gaming system that can allow a game to be appropriately advanced even by an experienced dealer by way of navigating the dealer in game advancement, thereby allowing fraud to be avoided and cost to be reduced.

In a first aspect of the present invention, a gaming system for executing a card game includes: a plurality of stations; a control unit that transmits and receives information relating to a game with the plurality of stations, and controls advancement of the game; a game portion that has a flat surface and has a plurality of card placement areas on which a card used for the card game is placed, and which constitutes a required number of opposing groups for determining winning or losing of the game; and an image input device that captures an image of at least one side of the card being placed on any of the plurality of card placement areas, and that transmits image data thus captured to the control unit, in which the game portion includes a plurality of indicators that is provided to correspond to the plurality of card placement areas, respectively, and in which the control unit includes an instructional device that gives an instruction relating to advancement of the game to a dealer, first memory that stores a game advancement program relating to the advancement of the game, and a controller that executes processing of: (a) activating the indicator that corresponds to a predetermined card placement area on which the card is placed, based on the game advancement program; (b) receiving the image data that is captured by the image input device; (c) calculating a score represented by the card based on the image data of the card placed in any of the plurality of card placement areas constituting the opposing group; (d) determining whether to further place the card in any of the plurality of card placement areas based on the score calculated in the processing of (c); (e) activating the indicator that corresponds to a card placement area in which the card is to be placed next among the plurality of card placement areas on which the card is placed based on the game advancement program, in a case where it is determined to further place the card in the processing of (d); (f) repeating the processing of (a) to (e) for a predetermined number of times and determining winning or losing of the game in a case where it is determined not to further place the card in the processing of (d); and (g) displaying a result of the game on the instructional device based on the processing of (f).

In the invention according to the first aspect, the controller first activates the indicator that corresponds to a predetermined card placement area on which the card is placed, based on the game advancement program, and then receives the image data captured by the image input device. Next, the controller calculates a score represented by the card based on the image data, and determines whether or not another card is to be placed in the card placement area. In a case where another card is to be placed, the indicator corresponding to the card placement area on which the card is to be placed next can be activated to prompt a dealer to place the card. If it is determined not to place a next card after the processing is performed for a predetermined number of times, a result of the game can be displayed on the instructional device.

In such a configuration, a position at which a card is to be placed next can be shown by activating the indicator and a result of the game can be automatically calculated and displayed. Accordingly, even in the case of the dealer being inexperienced, the game can be appropriately advanced.

In a second aspect of the present invention, a gaming system for executing a card game includes: a plurality of stations; a control unit that transmits and receives information relating to a game with the plurality of stations, and controls advancement of the game; a game portion that has a flat surface and has a plurality of card placement areas, on which a card used for the card game is placed, and which constitutes a required number of opposing groups for determining winning or losing of the game; and an image input device that captures an image of an upper side and a lower side of the card being placed on any of the plurality of card placement areas and transmits image data thus captured to the control unit, in which the game portion includes a plurality of indicators that is provided to correspond to the plurality of card placement areas, respectively, and in which the control unit includes an instructional device that gives an instruction relating to the advancement of the game to a dealer, first memory that stores a game advancement program relating to the advancement of the game, second memory that stores a plurality of pieces of standard image data that represent an obverse face on which a numeral or a symbol of the card is shown and a reverse face on which a numeral or a symbol of the card is not shown, and a controller that executes processing of: (a) activating the indicator that corresponds to a predetermined card placement area on which the card is placed, based on the game advancement program; (b) receiving the image data that is captured by the image input device; (c) determining whether standard image data representing the card is present or not, by comparing the image data received in the processing of (b) with a plurality of pieces of standard image data stored in the second memory; (d) calculating a score represented by the card based on the image data of the card positioned in any of the plurality of card placement areas constituting the opposing group, in a case where it is determined that the standard image data representing the card is present in the processing of (c); (e) displaying information on the instructional device, in a case where it is determined that the standard image data representing the card is not present in the processing of (c); (f) determining whether to further place the card in any of the plurality of card placement areas based on the score calculated in the processing of (d); (g) activating the indicator that corresponds to a card placement area in which the card is to be placed next among the plurality of card placement areas on which the card is placed based on the game advancement program, in a case where it is determined to further place the card in the processing of (f); (h) repeating the processing of (a) to (g) for a predetermined number of times and determining winning or losing of the game in a case where it is determined not to further place the card in the processing of (f); and (i) displaying a result of the game on the instructional device based on the processing of (h).

In the invention according to the second aspect, the controller first activates the indicator that corresponds to a predetermined card placement area on which the card is placed, based on the game advancement program, and then receives the image data captured by the image input device. The image data is obtained by capturing an upper face and a lower face of the card that is placed. Then, the image data is compared with the standard image data stored in the second memory, and in a case where the standard image data corresponding to the card being placed is not found, information can be displayed on the instructional device. Next, the controller calculates a score represented by the card, and determines whether or not another card is to be placed in a card placement area. In a case where another card is to be placed, the indicator corresponding to the card placement area on which the card is to be placed next can be activated to prompt a dealer to place the card. If it is determined that a next card is not to be placed after the processing is performed for a predetermined number of times, a result of the game can be displayed on the instructional device. In such a configuration, a position at which a card is to be placed next can be shown by activating the indicator and the card placed in the card placement area can be checked for appropriateness.

In addition, a result of the game can be automatically calculated and displayed. Accordingly, even in the case of the dealer being inexperienced, the game can be appropriately advanced. According to a third aspect of the present invention, in the gaming system as described in the second aspect, the plurality of pieces of standard image data is stored in the second memory for each group of cards used for the game.

In the invention according to the third aspect, in addition to the gaming system described in the second aspect, the plurality of pieces of standard image data is stored in the second memory for each group (deck) of cards used for the game.

In such a configuration, even in a case where a plurality of group of cards is used in the game and where a group of cards already used is to be discarded, another group of cards can be used for conducting a game. In addition, in this configuration, groups of cards having different groups of symbols and the like can be used.

According to a fourth aspect of the present invention, in the gaming system as described in the second aspect the plurality of pieces of standard image data is stored in the second memory for each group of cards used for the game, the standard image data of the obverse face is stored in the second memory for each numeral or each symbol of the card, and the standard image data of the reverse face includes one set of standard image data that is stored in the second memory, for each group of cards.

In the invention according to the fourth aspect, in addition to the gaming system described in the second aspect, the plurality of pieces of standard image data is stored in the second memory for each group (deck) of cards used for the game. The standard image data of the obverse face of the card is stored in the second memory for each numeral or each symbol of the card; and the standard image data of the reverse face is stored in the second memory, one for each group of cards.

In such a configuration, even in a case where a plurality of group of cards is used in the game and where a group of cards already used is to be discarded, another group of cards can be used for conducting a game. In addition, in this configuration, groups of cards having different groups of symbols and the like can be used. In addition, since only one piece of standard image data is required for the reverse face, volume thereof in the memory and a cost thereof can be reduced.

In a fifth aspect of the present invention, a gaming system for executing a card game includes: a plurality of stations; a control unit that transmits and receives information relating to a game with the plurality of stations and controls advancement of the game; a game portion that has a flat surface and has a plurality of card placement areas, on which a card used for the card game is placed, and which constitutes a required number of opposing groups for determining winning or losing of the game; and an image input device that captures an image of at least one side of the card being placed on any of the plurality of card placement areas and transmits image data thus captured to the control unit, in which the game portion includes a plurality of indicators that is provided to correspond to the plurality of card placement areas respectively; and in which the control unit includes an instructional device that gives an instruction relating to the advancement of the game to a dealer, first memory that stores a game advancement program relating to the advancement of the game, second memory that stores a plurality of pieces of standard image data that represent an obverse face on which a numeral or a symbol of the card is shown and a reverse face on which a numeral or a symbol of the card is not shown, and a controller that executes: (a) activating the indicator that corresponds to a predetermined card placement area on which the card is placed, based on the game advancement program; (b) a receiving the image data that is captured by the image input device; (c) determining whether or not a face of the card represented by the image data is a face to be placed on the predetermined card placement area in the game advancement program; (d) displaying information on the instructional device, in a case where it is determined that a face of the card represented by the image data is not a face to be placed on the predetermined card placement area in the game advancement program in the processing of (c); (e) calculating a score represented by the card based on the image data of the card positioned in any of the plurality of card placement areas constituting the opposing group, in a case where it is determined that a face of the card represented by the image data is a face to be placed on the predetermined card placement area in the game advancement program in the processing of (c); (f) determining whether the card is to be further placed in any of the plurality of card placement areas based on the score calculated in the processing of (e); (g) activating the indicator that corresponds to a card placement area in which the card is to be placed next among the plurality of card placement areas on which the card is placed based on the game advancement program, in a case where it is determined that the card is to be further placed in the processing of (f); (h) repeating the processes (a) to (g) for a predetermined number of times and determining winning or losing of the game in a case where it is determined that the card is not to be further placed in the processing of (f); and (i) displaying a result of the game on the instruction device based on the processing of (h).

In the invention according to the fifth aspect, the controller first activates the indicator that corresponds to a predetermined card placement area on which the card is placed among a plurality of card placement areas provided in the game portion, based on the game advancement program, and then receives the image data captured by the image input device. The image data is obtained by capturing by the image input device at least one face of the card that is placed. Then, it is determined whether or not a face of the card represented by the image data is a face to be placed on the predetermined card placement area in the game advancement program, and in a case where the face is not a correct face (for example, the reverse face), information can be displayed on the instructional device. Furthermore, the controller compares the image data with the standard image data stored in the second memory, and in a case where the standard image data corresponding to the card being placed is not found, information can be displayed on the instructional device. Next, the controller calculates a score represented by the card, and determines whether or not another card is to be placed in the card placement area. In a case where another card is to be placed, the indicator corresponding to the card placement area on which the card is to be placed next can be activated to prompt a dealer to place the card. If it is determined that a next card is not to be placed after the processing is performed for a predetermined number of times, a result of the game can be displayed on the instructional device.

In such a configuration, a position at which a card is to be placed next can be shown by activating the indicator and the card placed in the card placement area can be checked for its face and appropriateness. In addition, a result of the game can be automatically calculated and displayed. Accordingly, even in the case of the dealer being inexperienced, the game can be appropriately advanced.

According to a sixth aspect of the present invention, in the gaming system as described in the fifth aspect, the plurality of pieces of standard image data is stored in the second memory for each group of cards used for the game.

In the invention according to the sixth aspect, in addition to the gaming system described in the fifth aspect, the plurality of pieces of standard image data is stored in the second memory for each group (deck) of cards used for the game. In such a configuration, even in a case where a plurality of group of cards is used in the game and where a group of cards already used is to be discarded, another group of cards can be used for conducting a game. In addition, in this configuration, groups of cards having different groups of symbols and the like can be used.

According to a seventh aspect of the present invention, in the gaming system as described in the fifth aspect, the plurality of pieces of standard image data is stored in the second memory for each group of cards used for the game, the standard image data of the obverse face is stored in the second memory for each numeral or each symbol of the card; and the standard image data of the reverse face includes one set of standard image data that is stored in the second memory, for each group of cards.

In the invention according to the seventh aspect, in addition to the gaming system described in the fifth aspect, the plurality of pieces of standard image data is stored in the second memory for each group (deck) of cards used for the game. The standard image data of the obverse face of the card is stored in the second memory for each numeral or each symbol of the card; and the standard image data of the reverse face includes one set of image data that is stored in the second memory for each group of cards.

In such a configuration, even in a case where a plurality of group of cards is used in the game and where a group of cards already used is to be discarded, another group of cards can be used for conducting a game. In addition, in this configuration, groups of cards having different groups of symbols and the like can be used. In addition, since only one piece of standard image data is required for the reverse face, the volume thereof in the memory and a cost thereof can be reduced.

In an eighth aspect of the present invention, a gaming system for executing a card game includes: a plurality of stations; a control unit that transmits and receives information relating to a game with the plurality of stations, and controls advancement of the game; a game portion that has a flat surface and has a plurality of card placement areas, on which a card used for the card game is placed, and which constitutes a required number of opposing groups for determining winning or losing of the game; and an image input device that captures an image of an upper side and a lower side of the card being placed on any of the plurality of card placement areas and transmits image data thus captured to the control unit, in which the game portion includes a plurality of indicators that is provided to correspond to the plurality of card placement areas, respectively; and the control unit includes an instructional device that gives an instruction relating to the advancement of the game to a dealer, first memory that stores a game advancement program relating to the advancement of the game, second memory that stores a plurality of pieces of standard image data that represent an obverse face on which a numeral or a symbol of the card is shown and a reverse face on which a numeral or a symbol of the card is not shown, and a controller that executes processing of: (a) activating the indicator that corresponds to a predetermined card placement area on which the card is placed, based on the game advancement program; (b) receiving the image data that is captured by the image input device; (c) determining whether a face of the card represented by the image data is a face to be placed on the predetermined card placement area in the game advancement program; (d) displaying information on the instructional device, in a case where it is determined that a face of the card represented by the image data is not a face to be placed on the predetermined card placement area in the game advancement program in the processing of (c); (e) determining whether standard image data representing the card is present or not, by comparing the image data received in the processing of (b) with a plurality of pieces of standard image data stored in the second memory; (f) displaying information on the instructional device, in a case where it is determined that the standard image data representing the card is not present in the processing of (e); (g) calculating a score represented by the card based on the image data of the card placed in any of the plurality of card placement areas constituting the opposing group, in a case where it is determined that the standard image data representing the card is present in the processing of (e); (h) determining whether to further place the card in any of the plurality of card placement areas based on the score calculated in the processing of (g); (i) activating the indicator that corresponds to a card placement area in which the card is to be placed next among the plurality of card placement areas on which the card is placed based on the game advancement program, in a case where it is determined to further place the card in the processing of (h); (j) repeating the processing of (a) to (i) for a predetermined number of times and determining winning or losing of the game in a case where it is determined not to further place the card in the processing of (h); and (k) displaying a result of the game on the instructional device based on the processing of (j).

In the invention according to the eighth aspect, the controller first activates the indicator that corresponds to a predetermined card placement area on which the card is placed, based on the game advancement program, and then receives the image data captured by the image input device. The image data is obtained by capturing by way of the image input device the upper and lower faces of the card that is placed. Then, it is determined whether or not a face of the card represented by the image data is a face to be placed on the predetermined card placement area in the game advancement program, and in a case where the face is not a right face (for example, the reverse face), information can be displayed on the instructional device. Then the controller compares the image data with the standard image data stored in the second memory, and in a case where the standard image data corresponding to the card being placed is not found, information can be displayed on the instructional device. Next, the controller calculates a score represented by the cards, and determines whether or not another card is to be placed in the card placement area. In a case where another card is to be placed, the indicator corresponding to the card placement area on which the card is to be placed next can be activated to prompt a dealer to place the card. If it is determined that a next card is not to be placed after the processing is performed for a predetermined number of times, a result of the game can be displayed on the instructional device.

In such a configuration, a position at which a card is to be placed next can be shown by activating the indicator and the card placed in the card placement area can be checked for its face and appropriateness. In addition, a result of the game can be automatically calculated and displayed. Accordingly, even in the case of the dealer being inexperienced, an operation of ending bet acceptance can be carried out according to an instructional image.

According to a ninth aspect of the present invention, in the gaming system as described in the eighth aspect, the plurality of pieces of standard image data is stored in the second memory for each group of cards used for the game.

In the invention according to the ninth aspect, in addition to the gaming system described in the eighth aspect, the plurality of pieces of standard image data is stored in the second memory for each group (deck) of cards used for the game. In such a configuration, even in a case where a plurality of group of cards is used in the game and where a group of cards already used is to be discarded, another group of cards can be used for conducting a game. In addition, in this configuration, groups of cards having different groups of symbols and the like can be used.

According to a tenth aspect of the present invention, in the gaming system as described in the eighth aspect, the plurality of pieces of standard image data is stored in the second memory for each group of cards used for the game, the standard image data of the obverse face is stored in the second memory for each numeral or each symbol of the card; and the standard image data of the reverse face includes one set of standard image data that is stored in the second memory, for each group of cards.

In the invention according to the tenth aspect, in addition to the gaming system described in the eighth aspect, the plurality of pieces of standard image data is stored in the second memory for each group (deck) of cards used for the game. The standard image data of the obverse face of the card is stored in the second memory for each numeral or each symbol of the card; and the standard image data of the reverse face includes one set of data that is stored in the second memory, for each group of cards.

In such a configuration, even in a case where a plurality of group of cards is used in the game and where a group of cards already used is to be discarded, another group of cards can be used for conducting a game. In addition, in this configuration, groups of cards having different groups of symbols and the like can be used. In addition, since only one piece of standard image data is required for the reverse face, the volume thereof in the memory and a cost thereof can be reduced.

According to the present invention, it is possible to provide a gaming system that can allow a game to be appropriately advanced even by an experienced dealer by way of navigating the dealer in game advancement, thereby allowing fraud to be avoided and cost to be reduced.

DETAILED DESCRIPTION OF THE INVENTION

Embodiments of the present invention are explained below with reference to the drawings.

Figure 1:
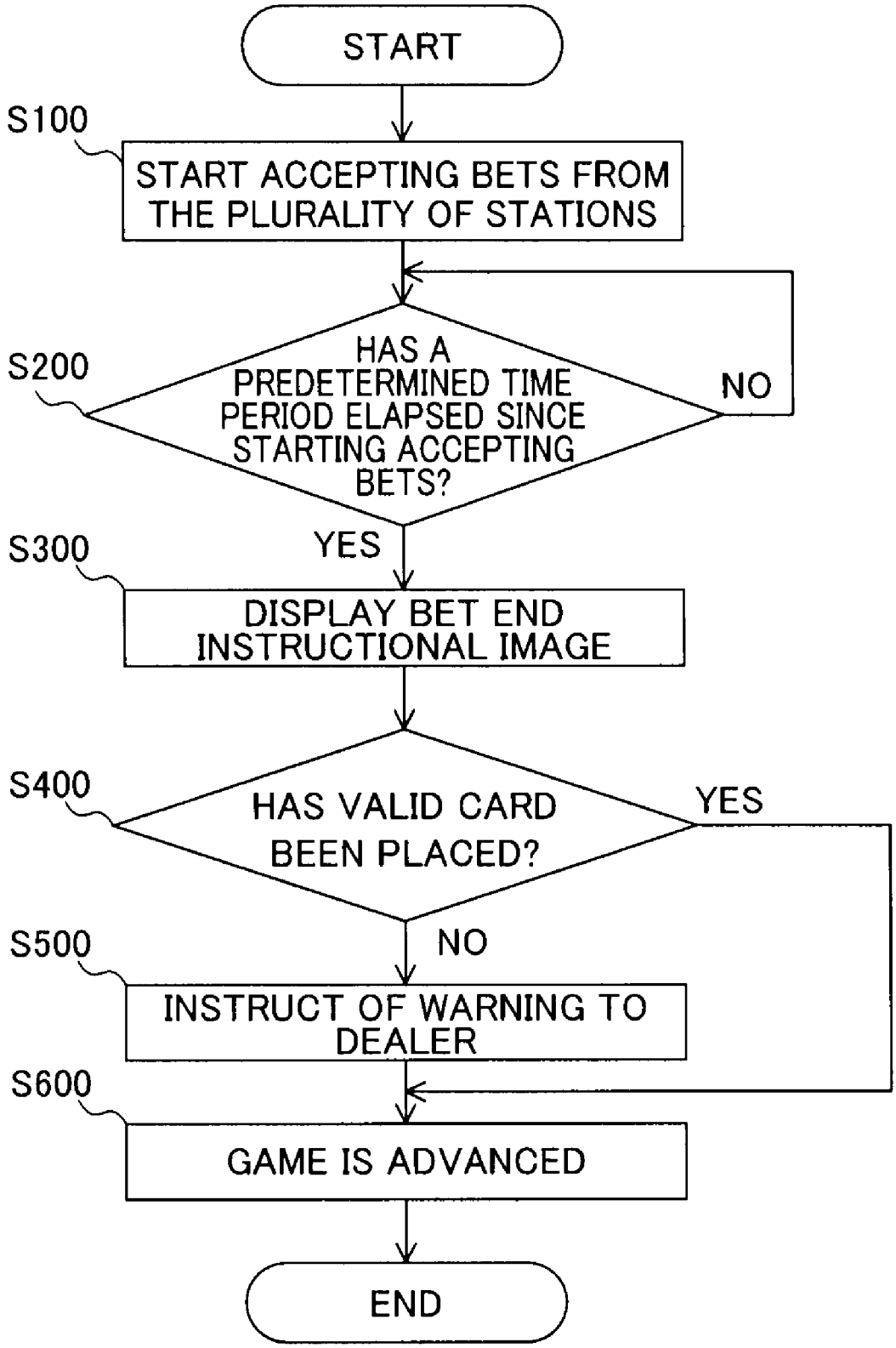
FIG. 1 is a flowchart schematically showing a process sequence of a gaming system according to an embodiment of the present invention.

More specifically, as described later and shown in FIG. 1, a CPU 81 starts accepting a bet from a plurality of stations 4 (Step S100), responds to a predetermined time period elapsing since starting accepting bets (Step S200), by displaying on a dealer-used display 210 an instructional image (bet end instructional image) for an operation input to end accepting a bet from the plurality of stations 4 (Step S300), determines the validity of a card that is placed (Step S400), warns a dealer of invalid card if the card is determined to be invalid (Step S500), and advances a game if the card is determined to be valid (Step S600).

Figure 2:
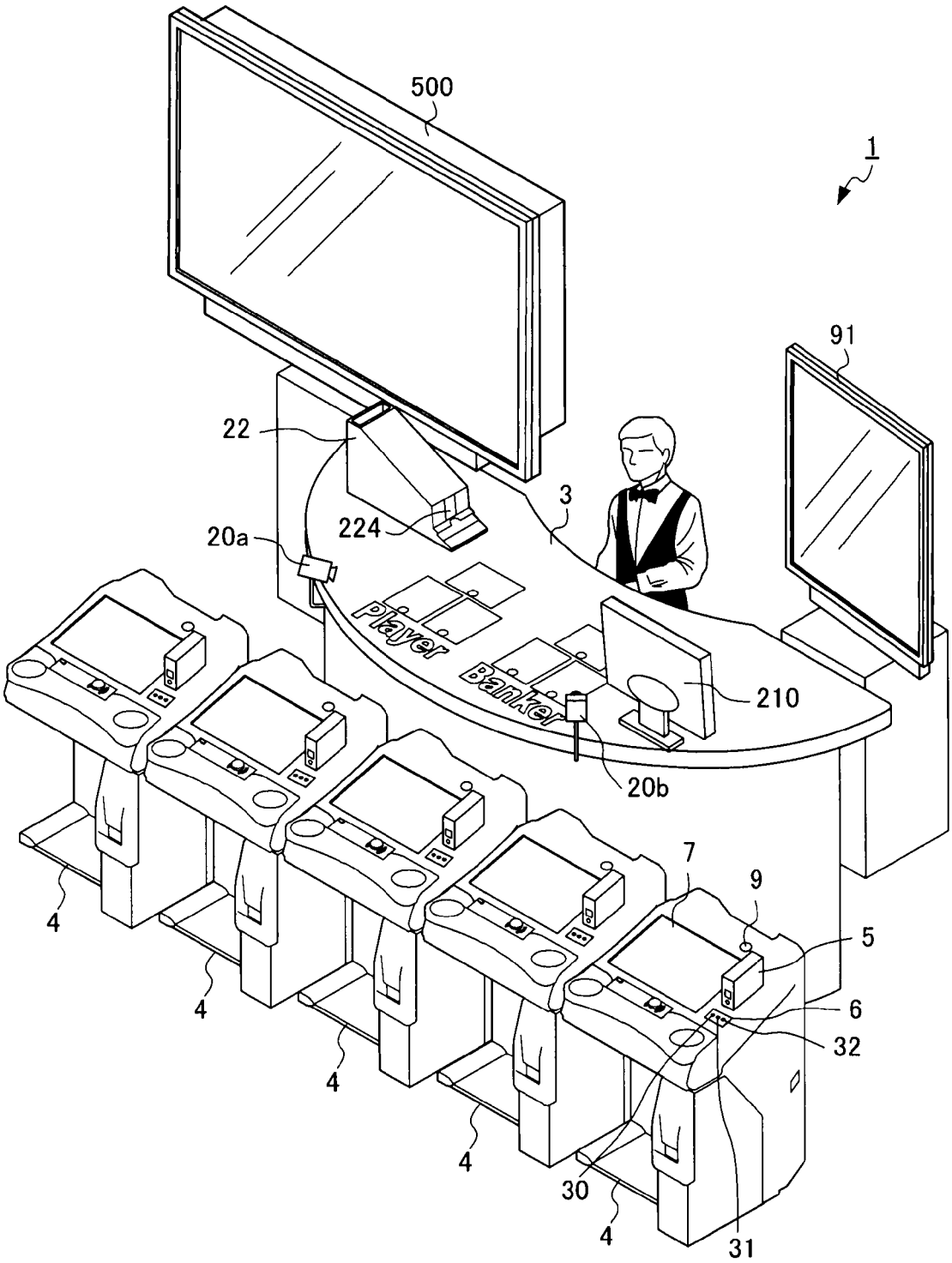
FIG. 2 is a perspective view of the gaming system according to the embodiment of the present invention.
Figure 3:
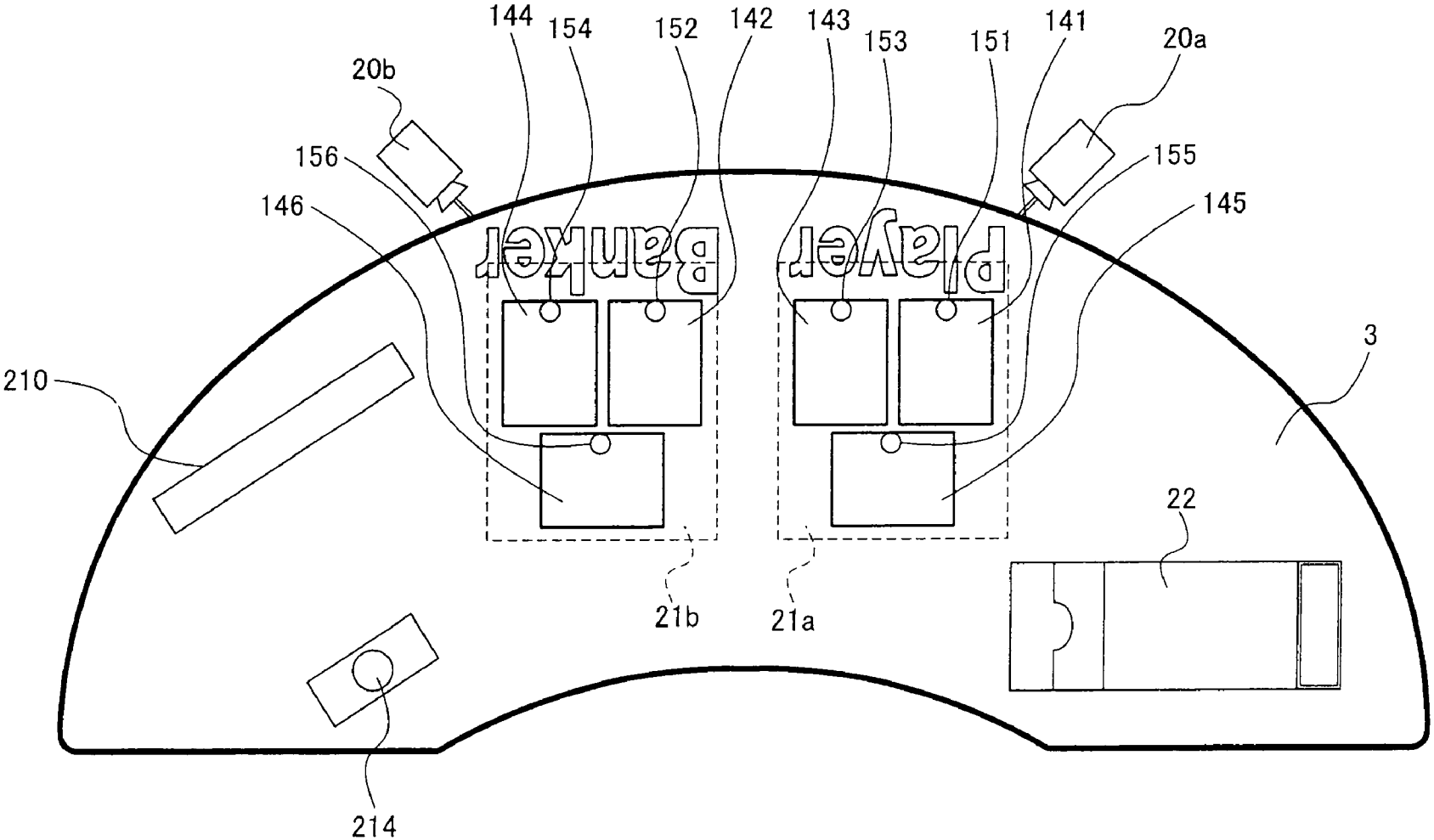
FIG. 3 is an enlarged view of a game portion of the gaming system shown in FIG. 2.
Figure 4:
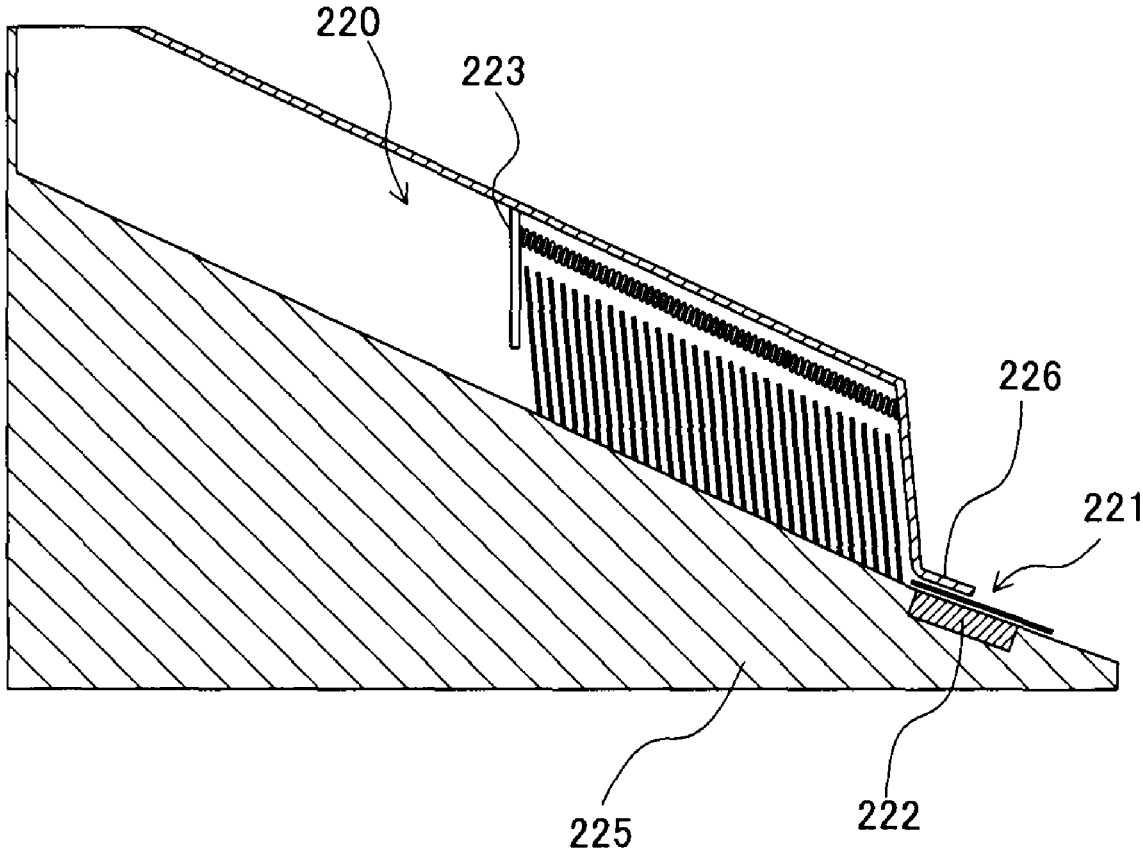
FIG. 4 is a horizontal cross-sectional view of a card storage device of the gaming system shown in FIG. 2.

Referring to FIGS. 2 and 4, a gaming system 1 of the present embodiment will be explained. FIG. 2 is a perspective view schematically showing an example of the gaming system 1. FIG. 3 is a view from above a game portion 3 included in the gaming system 1. FIG. 4 is a horizontal cross-sectional view of a card storage device 22.

Figure 5:
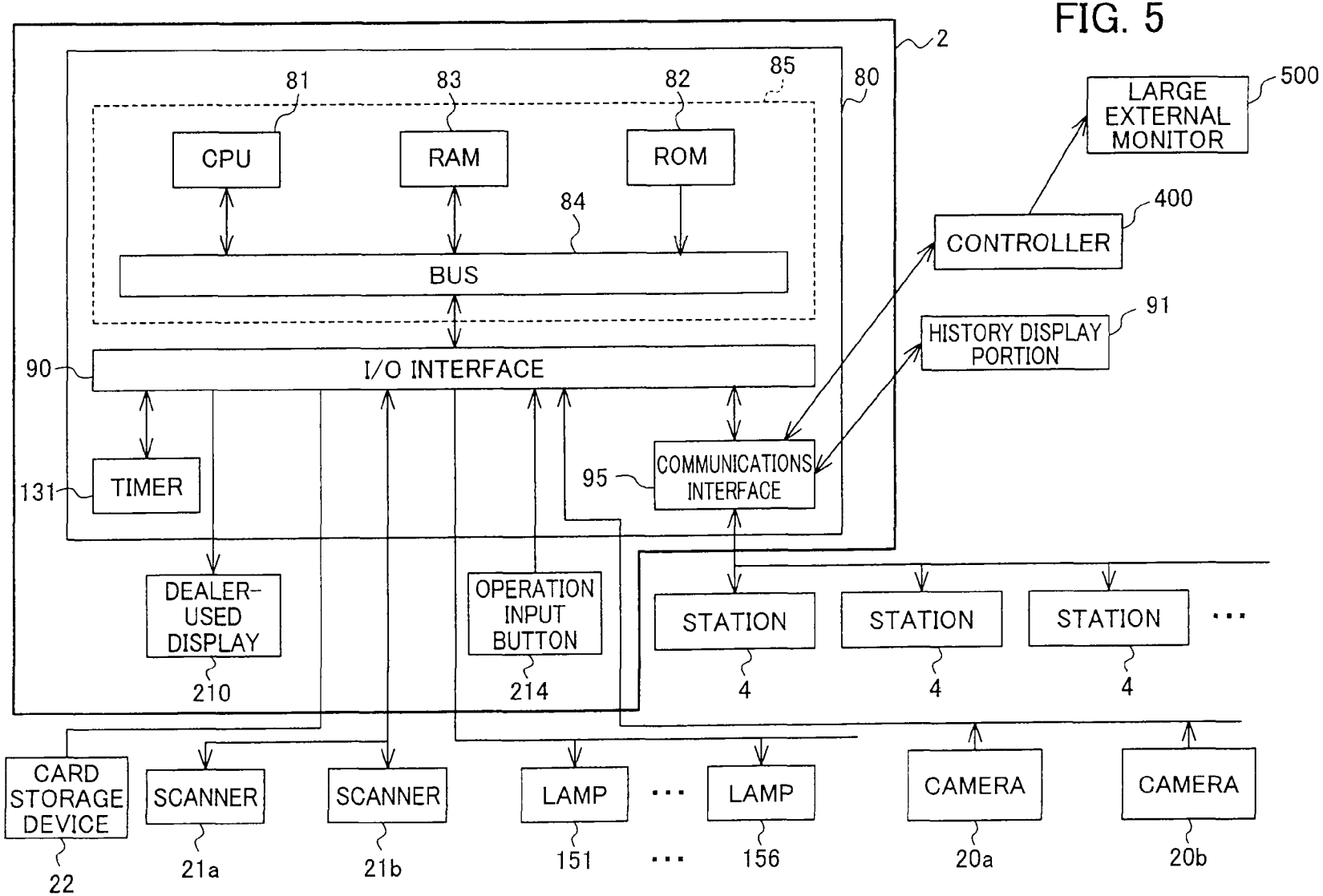
FIG. 5 is a block diagram showing an internal configuration of a control unit according to the embodiment of the present invention.

The gaming system 1 of the present embodiment is configured with a plurality of stations 4, a game portion 3, and a control unit 2 (described later in FIG. 5). In addition, a history display portion 91 is provided at a position viewable by players playing the game at the plurality of stations 4. Furthermore, a large external monitor 500 is provided at a position viewable by people surrounding the plurality of stations 4.

The control unit 2 controls the entirety of the gaming system 1. In addition, the control unit 2 includes a dealer-used display 210 that the dealer uses, an operation input button 214 (FIG. 3), and a CPU 81 (described later in FIG. 5), and performs control of the entirety of the gaming system 1 according to operations by the dealer. The dealer-used display 210 is positioned to be unviewable by players seated at each of the stations 4. In addition, the body portion (not illustrated) of the control unit 2 is positioned below the game portion 3.

The stations 4 are terminals operated by players. The stations 4 accept a bet operation from a player seated at a seat (not illustrated) prepared in front of the station 4, and furthermore, performs processing of paying out game winnings. The station 4 is provided with an image display device 7. Players seated at each station 4 participate in a baccarat game by performing a BET input on any of a "Player (player position)", "Banker (banker position), and "Tie (draw)".

The station 4 is provided with a game media receiving device 5 into which game media such as medals used in a game is inserted, a control portion 6 composed of a plurality of control buttons to which predetermined instructions are input by a player and the like, and an image display device 7 on which images related to a baccarat game and the like are displayed. Then, the player can participate in a game while looking at an image displayed on the image display device 7 by operating the control portion 6 and the like.

Furthermore, at the top right of the image display device 7 of each station 4, a speaker 9 is provided that is capable of outputting sound.

The control portion 6 is provided at a side of the image display device 7 of the station 4. A select button 30, cash out button 31, and help button 32 are disposed on the control portion 6.

The select button 30 is a button that is pressed, after performing a BET operation, when selecting the BET operation. In addition, even in cases other than a BET operation, The select button 30 is a button that is pressed when selecting an input performed by the player.

The cash out button 31 is a button usually pressed after a game ends, and when the cash out button 31 is pressed, game media is refunded from a payout opening according to the credits owned by the player.

The help button 32 is a button pressed in a case where operation methods of the game and the like are unclear, and when the help button 32 is pressed, a help screen showing a variety of operational information is displayed immediately thereafter on the image display device 7.

The game portion 3 includes: card placement areas 141 to 146 in which cards used in a baccarat game are to be placed; lamps 151 to 156 as indicators for a dealer, respectively provided in the card placement areas 141 to 146; cameras 20*a* and 20*b* as image input devices; scanners 21*a* and 21*b* as image input devices disposed on a lower face side of the card placement areas 141 to 146, and a card storage device 22 for storing cards to be distributed.

The card placement areas 141 to 146 are areas in which cards used in a baccarat game are to be placed. The dealer places cards one by one in a predetermined order in the card placement areas 141 to 146. In the gaming system 1 of the present embodiment that provides a baccarat game, the opposing groups required for determining winning or losing of the game are player side and banker side. For each opposing group, three of the card placement areas 141 to 146 are provided.

The lamps 151 to 156 are provided for navigating the dealer on the card placement area on which a card should be placed, and the lamps 151 to 156 respectively correspond to the card placement areas 141 to 146. For example, when the lamp 151 is illuminated, the dealer can understand that the card should be placed on the card placement area 141. It should be noted that the lamps 151 to 156 are each configured with LED luminous bodies.

The cameras 20*a* and 20*b* capture an image of the opposing groups, the player side and banker side, respectively, in the card placement areas 141 to 146. The cameras 20*a* and 20*b* capture an image of an upper face of the cards placed in the card placement areas 141 to 146.

The card storage device 22 stores the cards to be distributed in the game and recognizes a symbol of the cards being taken out one by one and the number of the cards being taken out. As shown in FIGS. 2 and 4, the card storage device 22 includes a card storage unit 220 for storing the cards, a card outlet opening 221, a detection unit 222 provided in the card outlet opening 221, and a hold-down plate 223 that holds the cards to be stored toward the card outlet opening 221.

The card storage unit 220 stores the cards. In the present embodiment, a plurality of decks of the cards can be stored therein. The cards are stored such that a reverse side of the card is directed toward the card outlet opening 221.

As used herein, the reverse side of the card is a side on which a numeral or a symbol is not marked. On the reverse side of the card, a pattern or a picture that is different from deck to deck is printed. An obverse side of the card is a side on which a numeral or a symbol is marked. The numeral of the card is any one of the numerical numbers 1 to 10, provided for each of four suits, diamonds, hearts, clubs, and spades. The symbol of the card is any one of symbols Jack, Queen, and King, representing numerical numbers 11 to 13 respectively, provided for each of the four suits. In addition, a Joker can be included depending on a type of card game.

The card outlet opening 221 is provided at an end of the card storage unit 220, through which cards stored in the card storage unit 220 are taken out one by one. More specifically, on an end-side face of the card storage unit 220, an exposed portion 224 is formed through which a card in the front row is exposed. When a dealer touches and pushes down the card in the front row, the card is pushed out through the card outlet opening 221 formed below the exposed portion 224. In the card outlet opening 221, an upper plate 226 is provided from an upper face of a base portion 225, which is a base of the card storage device 22, with a gap allowing a card to go through. The card pushed out from the exposed portion 224 is pushed out therethrough one by one.

The detection unit 222 is disposed inside the base portion 225 so as to face the upper plate 226. The detection unit 222 detects a numeral or a symbol of the card. More specifically, an obverse side of the card is directed toward the detection unit 222 when a card goes through the card outlet opening 221. At this time, the detection unit 222 reads the numeral or a symbol of the card. For the detection, conventional image recognition methods including image recognition by a camera, recognition by an optical device such as scanner, and the like can be used.

The scanners 21*a* and 21*b* are disposed below the card placement areas 141 to 146 and scan the lower face of the cards placed in the card placement areas 141 to 146. More specifically, the scanners 21*a* and 21*b* are embedded in the game portion 3 so as to correspond to a player side and a banker side, respectively. In other words, the scanner 21*a* is disposed below the card placement areas 141, 143, and 145 on the player side, and scans the card placement areas 141, 143, and 145 as a whole. In addition, the scanner 21*b* is disposed below the card placement areas 142, 144, and 146 on the banker side, and scans the card placement areas 142, 144, and 146 as a whole. The scanners 21*a* and 21*b* are optical scanners in the present embodiment; however, other types of scanners can also be used, and alternatively, the card can be recognized by image recognition by a camera and the like.

A history display portion 91 is a display on which game history such as which side among a player side and banker side won in each game up to that previous. Details thereof are described later.

A large external monitor 500 is a display on which live-pictures such as game advancement, demo screens, and the like are displayed. Details thereof are described later.

This warning processing is described later with reference to FIGS. 7 to 26.

A configuration of the control unit is hereinafter described with reference to FIG. 5. FIG. 5 is a block diagram showing a functional configuration of the control unit.

A main control portion 80 of the control unit 2 has a microcomputer 85 that is mainly configured with a CPU 81, ROM 82, RAM 83, and a bus 84 that carries out data transmission between each of these.

The CPU 81 is connected to the dealer-used display 210, a card reader 212, and operation input button 214 via an I/O interface 90.

The CPU 81 sends picture data of various screens, which are described later in FIGS. 10, 12, 15, 17, 19, and 21 to 23, to the dealer-used display 210. The CPU 81 determines whether a bet end instruction signal has been received from the operation input button 214.

In addition, the CPU 81 is connected via the I/O interface 90 to a timer 131 capable of measuring time. Moreover, the CPU 81 is connected via the I/O interface 90 to the lamps 151 to 156. The lamps 151 to 156 emit light of each color when navigating the dealer of a card placement area based on an output signal from the CPU 81.

In addition, cameras 20*a* and 20*b* and scanners 21*a* and 21*b* are connected to the I/O interface 90, and the CPU 81 receives from the cameras 20*a* and, 20*b* and scanners 21*a* and 21*b* image data of an upper face and lower face of cards that have been placed on the card placement areas 141 to 146.

Furthermore, a communications interface 95 is connected to the I/O interface 90, and a main control portion 80 performs transmission and reception of data such as BET information and dividend information between each station 4 via this communications interface 95.

Additionally, the history display portion 91 is connected to the communications interface 95, and the main control portion 80 performs transmission and reception of data of game history with the history display portion 91.

Moreover, the large external monitor 500 is connected to the communications interface 95 via the controller 400, and the main control portion 80 performs transmission and reception of image data and the like with the large external monitor 500.

Live pictures of game advancement and the like, demo screens, and the like are displayed on this large external monitor 500. In this way, it is possible to attract the interest of people around the large external monitor 500.

The card storage device 22 is also connected to the communication interface 95 and the main control portion 80 receives information of a card detected by the detection unit 222 of the card storage device 22, from the card storage device 22.

The ROM 82 in the main control portion 80 stores a game advancement program for implementing basic features of the control unit 2, and more specifically a program for controlling various devices provided in the game portion 3 and a program for controlling each station 4, as well as holding winnings tables, data indicating a predetermined time T, data indicating a specific value TT, and the like.

The RAM 83 is memory that temporarily stores various data computed by the CPU 81, and temporarily stores BET information sent from each station 4, information of cards sent from the card reader 212, image data of cards sent from the cameras 20*a*, 20*b*, scanners 21*a*, 21*b* and the detection portion 222 of the card storage device 22, data related to the results of processing executed by the CPU 81, and the like, for example.

The RAM 83 also stores the standard image data. The standard image data is image data obtained in advance by capturing images of the card used in the gaming system 1 using the cameras 20*a* and 20*b*, or the scanners 21*a* and 21*b*. The standard image data is provided for each deck of cards and includes image data of the reverse face of the card and image data of the card for each numeral (1 to 9) and each symbol (J, Q, K) in each suit. An image of the card placed in the card placement areas 141 to 146 is checked against the standard image data in verification/warning processing (FIG. 20) described later. The standard image data can be stored in the ROM 82.

The CPU 81 controls various devices provided to the game portion 3 and executes control processing along with game advancement, based on data and programs stored in the ROM 82 and RAM 83.

In addition to control processing along with game advancement, the CPU 81 performs transmission and reception of data with each station 4, and has functions for controlling each station 4 to advance a game. More specifically, BET information sent from each station 4 is received. Furthermore, dividend amounts to be paid out at each station 4 are calculated based on a game result ("Player (player position) winning, "Banker (banker position) winning, or "Tie (draw)") and BET information sent from each station 4 by referring to a dividend table stored in the ROM 82.

Figure 6:
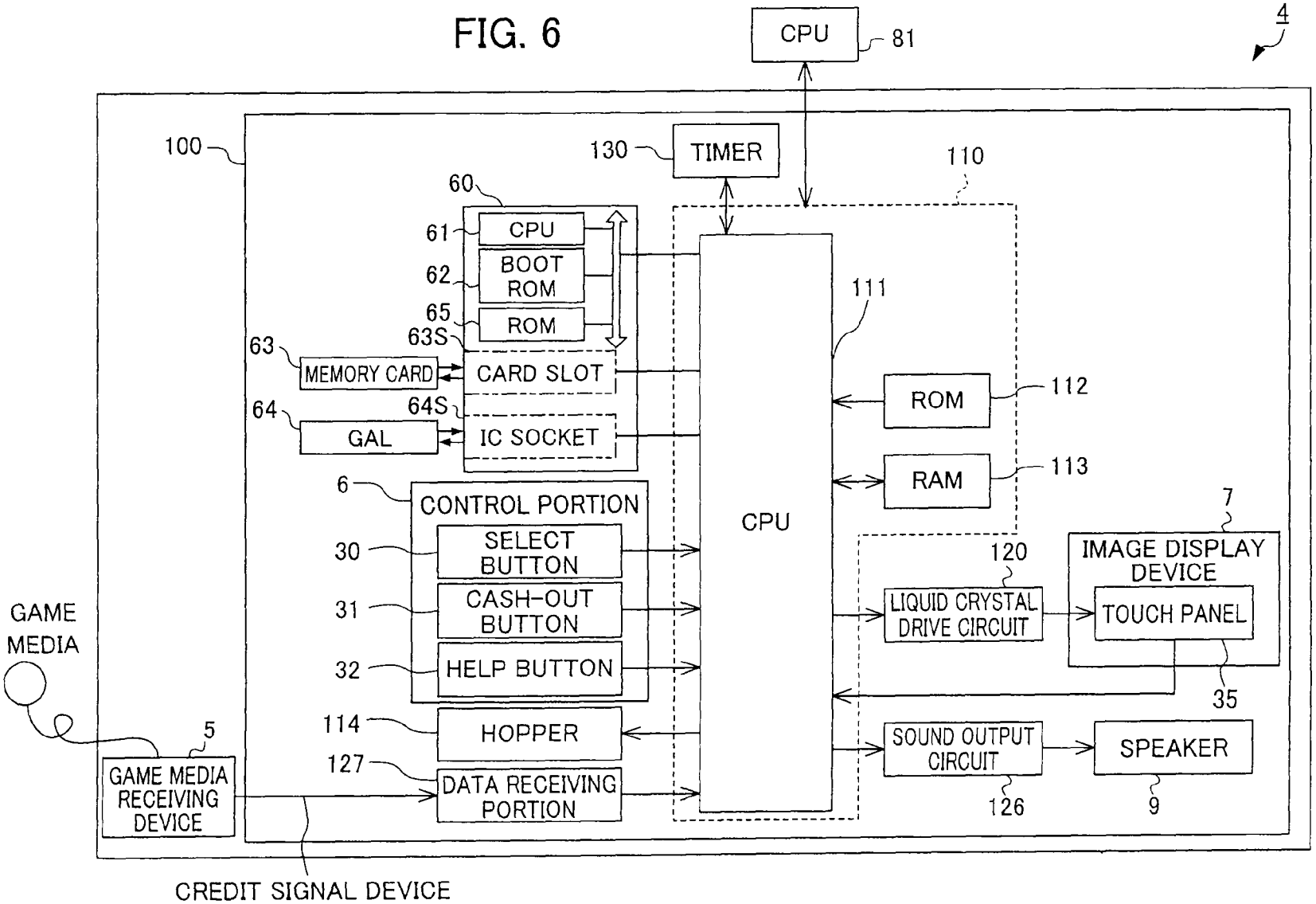
FIG. 6 is a block diagram showing an internal configuration of a station shown in FIG. 2.

FIG. 6 is a block diagram which shows the inside constitution of a station shown in FIG. 2.

The station 4 is provided with a body portion 100 in which the image display device 7 is provided, and a game media receiving device 5 installed in the body portion 100. Furthermore, the body portion 100 is provided with a station control portion 110 and a few pieces of peripheral equipment.

The station control portion 110 is provided with a CPU 111, ROM 112, and RAM 113.

The ROM 112 stores programs for implementing basic functions of the station 4, various programs necessary for control of the station 4, data tables, and the like.

The select button 30, cash out button 31, and help button 32 provided in the control portion 6 are each connected to the CPU 111. Then, the CPU 111 controls the various corresponding operations that should be executed according to the operation signal output by pressing each button and the like. More specifically, various processing is executed based on an input signal supplied from the control portion 6 in response to an operation of a player having been input, as well as data and programs stored in the ROM 112 and RAM 113, and the result thereof is sent to the CPU 81 of the main control portion 80.

Furthermore, the CPU 111 receives command signals from the CPU 81 of the main control portion 80, and controls peripheral devices configuring the station 4. In addition, the CPU 111 executes various processing based on input signals supplied from the control portion 6 and touch panel 35, as well as data and programs stored in the ROM 112 and RAM 113. Then, the peripheral devices configuring the station 4 are controlled based on the results of the processing. It should be noted that, in regards to by which method processing is performed, it is set for each processing depending on the contents of this processing. For example, game media payout processing corresponds to the former, and BET operation processing by a player corresponds to the latter.

A hopper 114 is connected to the CPU 111, and the hopper 114 pays out a predetermined number of game media from the payout opening according to a command signal from the CPU 111.

The image display device 7 is connected to the CPU 111 via a liquid crystal drive circuit 120. The liquid crystal drive circuit 120 is configured with program ROM, image ROM, an image control CPU, work RAM, a VDP (video display processor), video RAM, and the like. Programs for image control related to display on the image display device 7, and various selection tables are stored in the program ROM. Dot data for forming images to be displayed by the image display device 7, for example, are stored in the image ROM. In addition, the image control CPU performs determination of an image to be displayed on the image display device 7 from among dot data stored beforehand in the image ROM, based on parameters set by the CPU 111, according to the image control program stored beforehand in the program ROM. In addition, the work RAM is configured as a temporary storage means for when the image control program is executed by the image control CPU. Moreover, the VDP forms an image according to display contents determined by the image control CPU, and performs output thereof to the image display device 7. It should be noted that the video RAM is configured as a temporary storage means for when an image is formed by the VDP.

Furthermore, a sound output circuit 126 and speaker 9 are connected to the CPU 111, and the speaker 9 generates various sound effects when performing various renderings based on output signals from the sound output circuit 126. In addition, a game media receiving device 5, which is a device that receives money and game media such as medals, is connected to the CPU 111 via a data receiving portion 127. The data receiving portion 127 receives a credit signal sent from the game media receiving device 5, and the CPU 111 adds a number of credits of a player stored in the RAM 113 based on the credit signal thus sent.

The timer 131, which is capable of measuring time, is connected to the CPU 111.

A gaming board 60 is provided with a CPU (Central Processing Unit) 61, ROM 65 and boot ROM 62, a card slot 63S compliant with a memory card 63, and an IC socket 64S compliant with GAL (Generic Array Logic) 64, which are mutually connected by an internal bus.

The memory card 63 consists of non-volatile memory such as compact flash (registered trademark), and stores a game program and a game system program.

In addition, the card slot 63S is configured so that the memory card 63 can be inserted thereinto, and is connected to the CPU 111 by an IDE bus. Therefore, it is also possible to change the type of game performed by the station 4 and contents by pulling the memory card 63 out from the card slot 63S, writing a different game program and game system program onto the memory card 63, and inserting this memory card 63 into the card slot 63S. In addition, it is possible to change the type of game performed by the station 4 and contents by replacing the memory card 63 on which one game program and game system program are stored with a memory card 63 on which a different game program and game system program are stored. A program related to game advancement and the like are included in the game program. In addition, image data, sound data and the like output during a game are included in the game program.

The GAL 64 is a type of PLD having an OR fixed array structure. The GAL 64 is provided with a plurality of input ports and output ports, and when predetermined data is input to an input port, data corresponding to this data is output from an output port. In addition, the IC socket 64S is configured so that the GAL 64 is detachable, and is connected to the CPU 111 by a PCI bus.

The CPU 61, ROM 65 and boot ROM 62, which are mutually connected by an internal bus, are connected to the CPU 111 by the PCI bus. The PCI bus performs signal transfer between the CPU 111 and the gaming board 60, and carries out electric power supply from the CPU 111 to the gaming board 60. Country identifying information and an authentication program are stored in the ROM 65. A preliminary authentication program, program (boot code) for the CPU 61 to start the preliminary authentication program, and the like are stored in the boot ROM 62.

The authentication program is a program (tamper checking program) for authenticating the game program and game system program. The authentication program is written in accordance with a sequence (authentication sequence) in which confirmation and verification that the game program and game system program, which are the targets of authentication processing, have not been tampered are performed, i.e. authentication of the game program and game system program. The preliminary authentication program is a program for authenticating the authentication program described above. The preliminary authentication program is written in accordance with a sequence (authentication sequence) in which verification that the authentication program, which is the target of authentication processing, has not been tampered is performed, i.e. authentication of the authentication program.

Next, processing executed in the main control portion of a game device according to the present embodiment is explained with reference to FIGS. 7 to 26.

Figure 7:
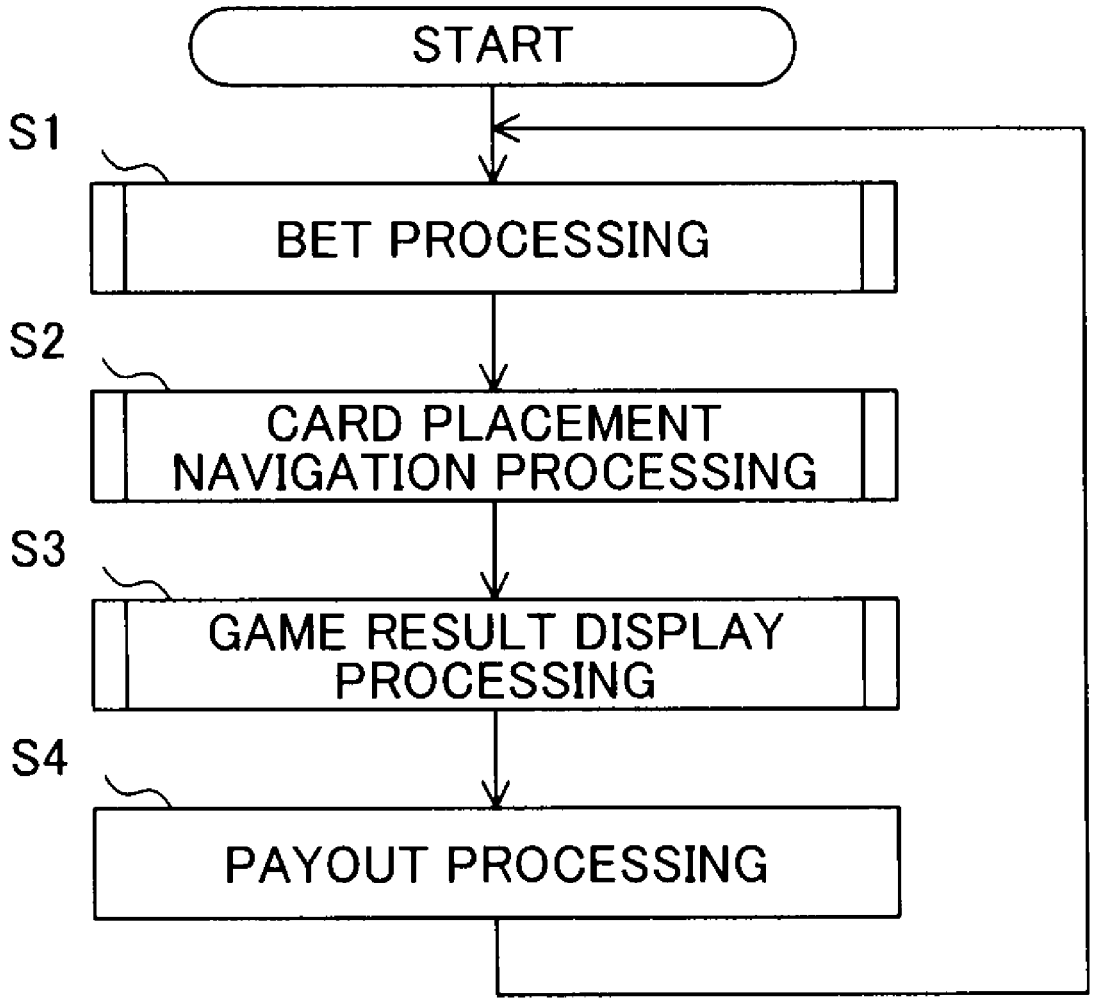
FIG. 7 is a flowchart of baccarat game execution processing according to the embodiment of the present invention.

First, baccarat game execution processing is described with reference to FIG. 7. FIG. 7 is a flowchart showing the baccarat game execution processing.

Figure 8:
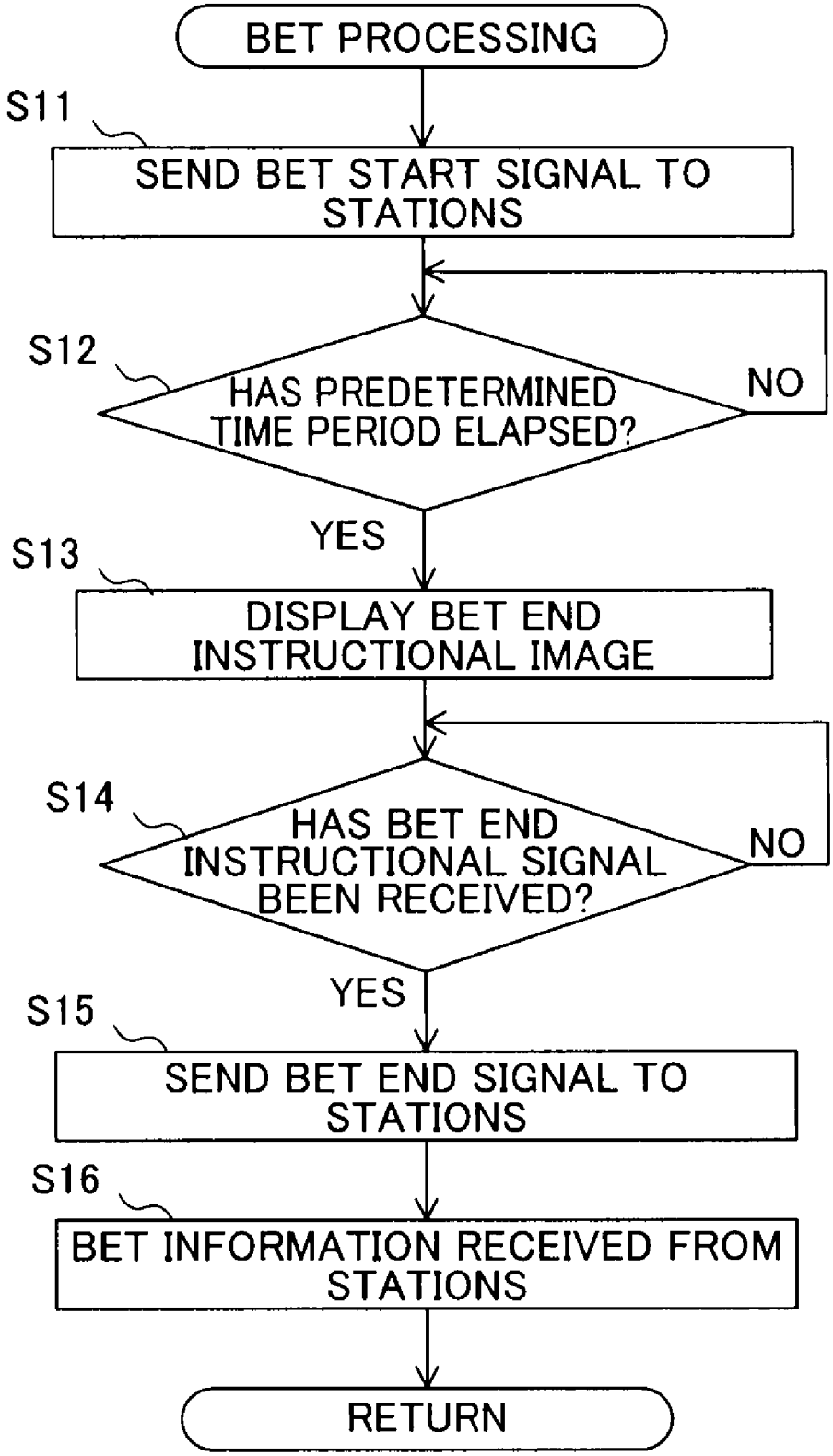
FIG. 8 is a flowchart showing bet processing according to the embodiment of the present invention.

First, in Step S1, the CPU 131 executes bet processing, which is described later in FIG. 8, and in Step S2, the CPU 81 executes card placement navigation processing, which is described later in FIG. 13. In Step S3, the CPU 81 executes game result display processing, which is described later in FIG. 24, and in Step S4, executes payout processing in response to game results ("Player (player position) winning, "Banker (banker position) winning, or "Tie (draw)") and BET information sent from each station 4, and then returns to Step S1.

Figure 9:
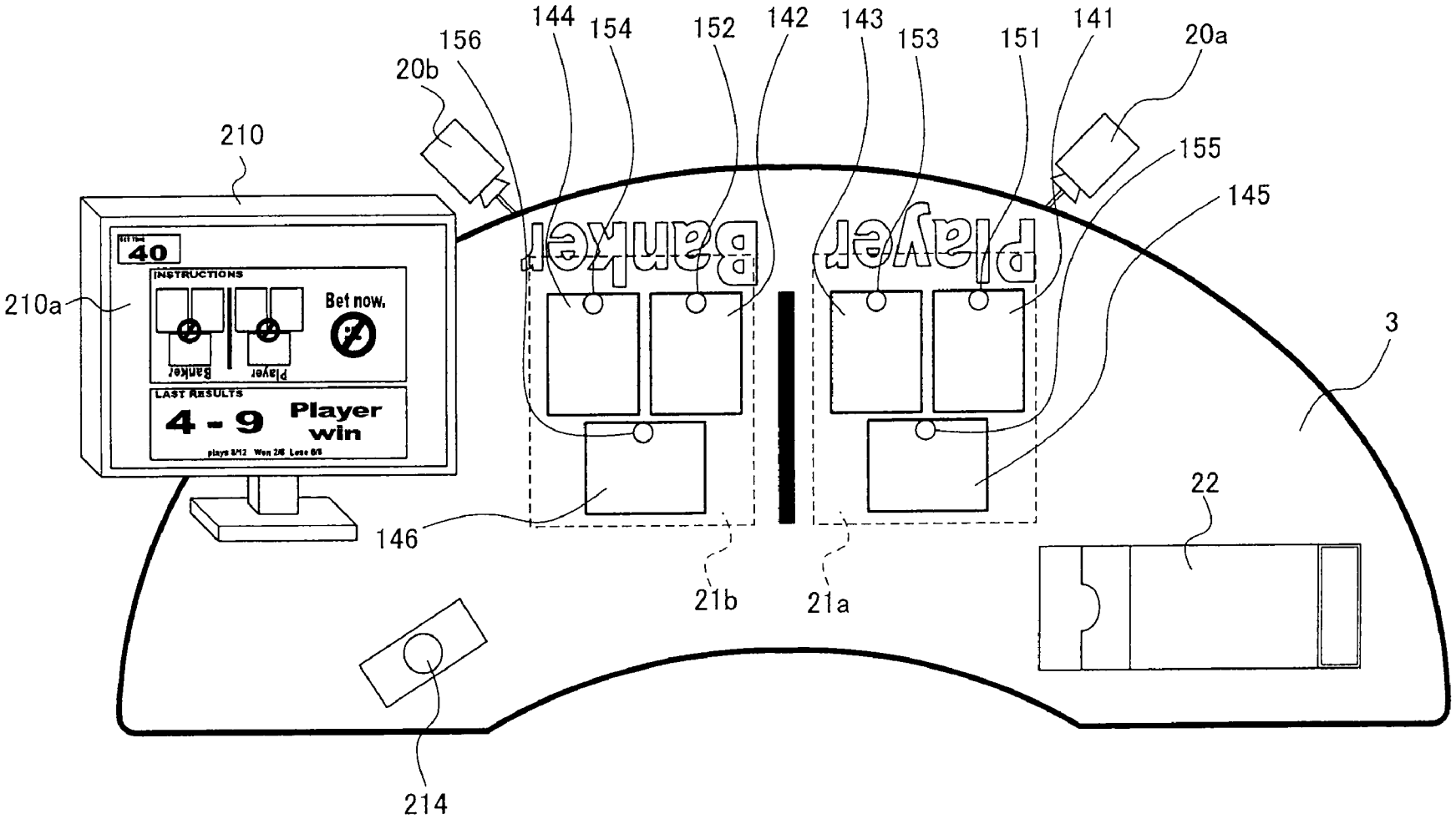
FIG. 9 is a view showing an appearance of the game portion according to the embodiment of the present invention.
Figure 10:
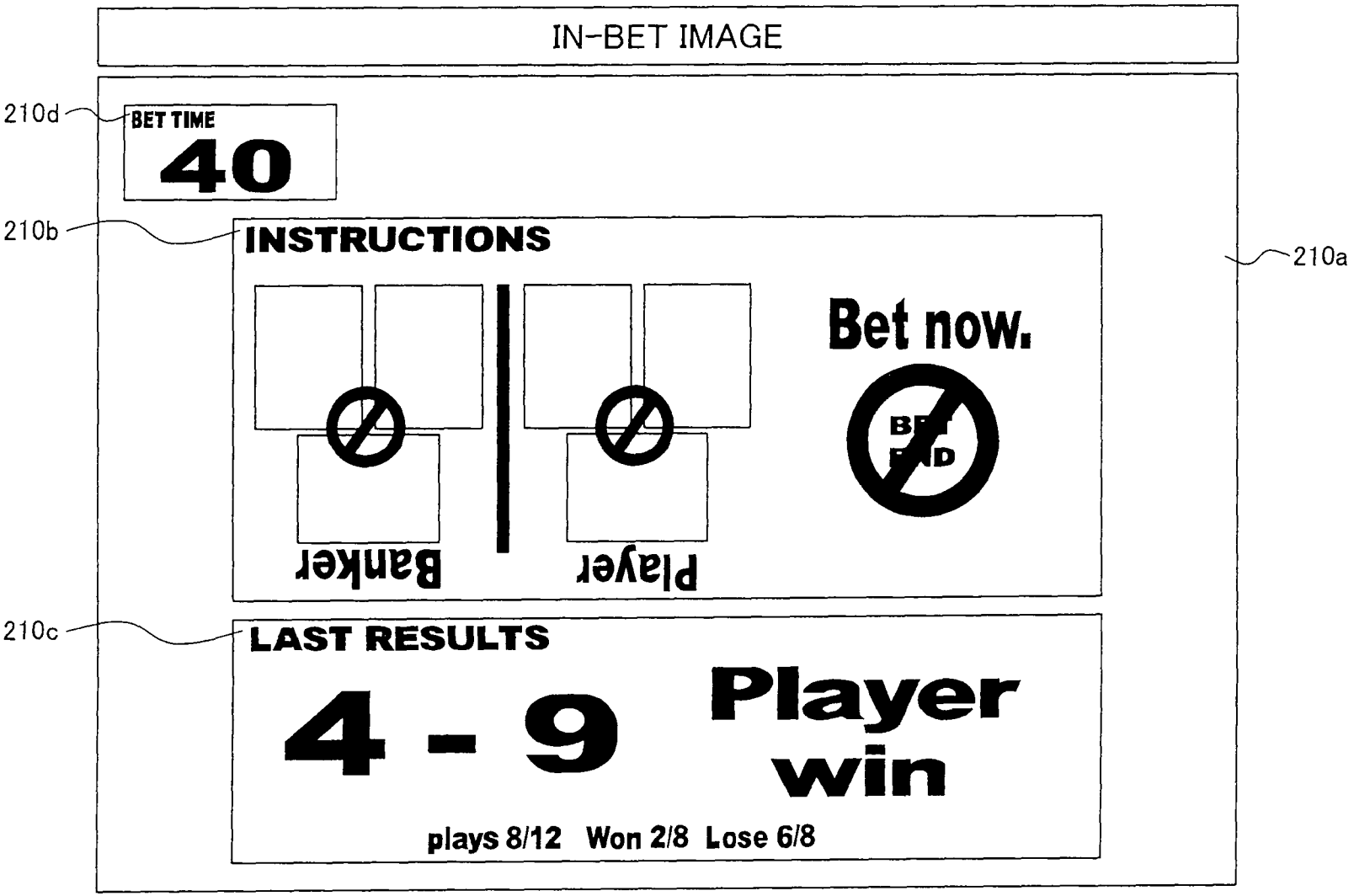
FIG. 10 is a view showing a display example of a dealer-used display according to the embodiment of the present invention.
Figure 11:
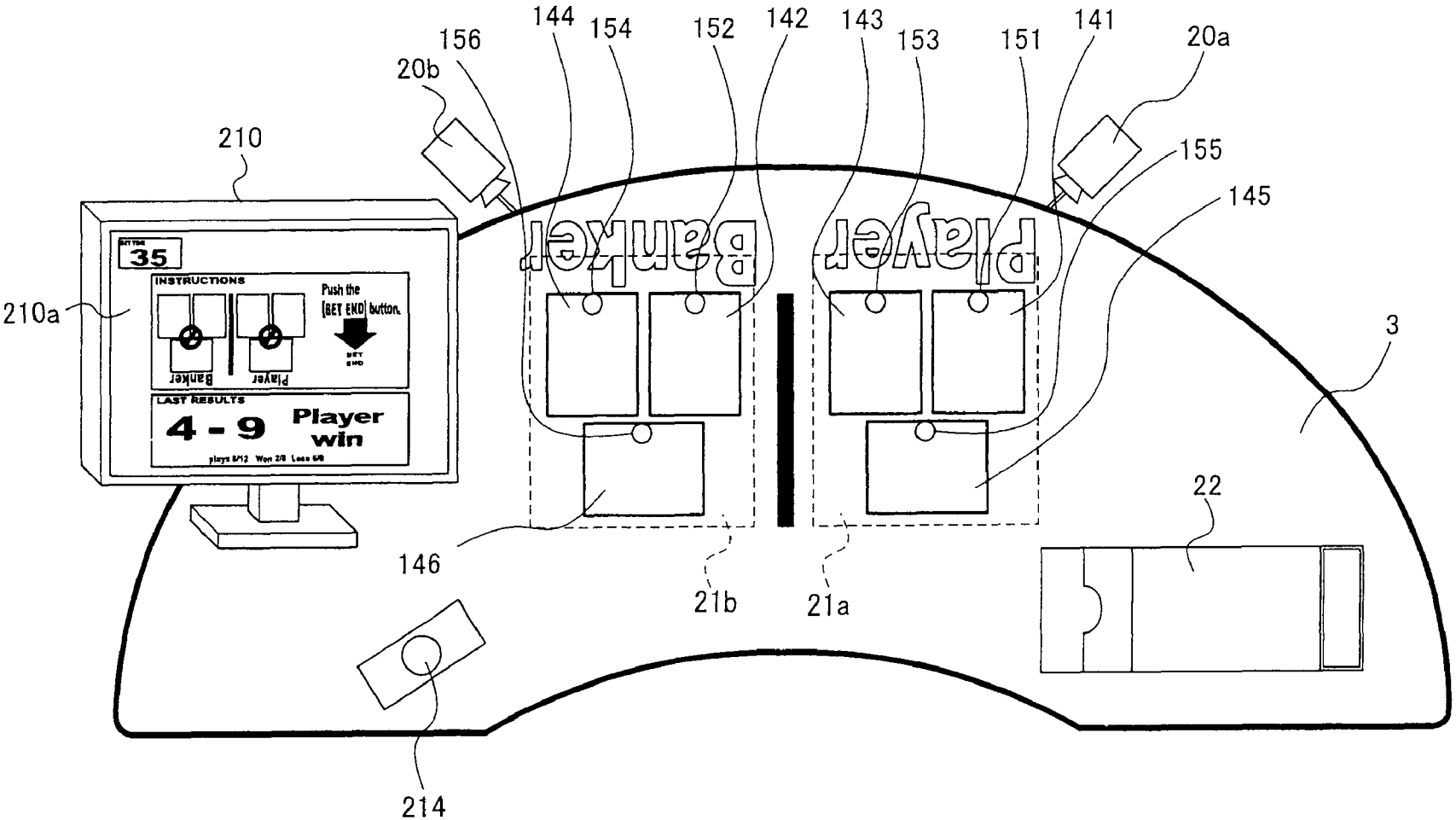
FIG. 11 is a view showing an appearance of the game portion according to the embodiment of the present invention.
Figure 12:
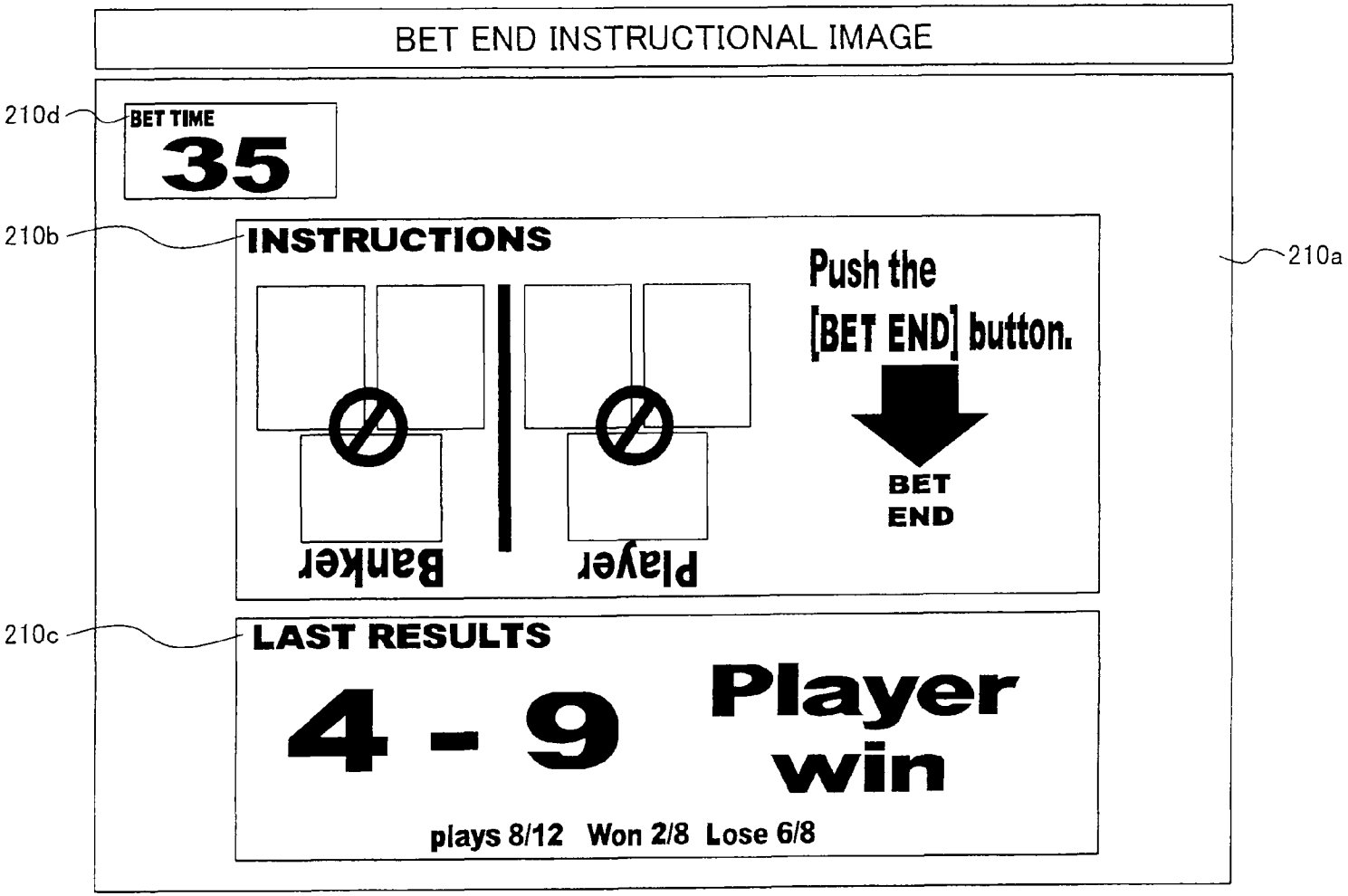
FIG. 12 is a view showing a display example of a dealer-used display according to the embodiment of the present invention.

Here, appearances during betting are explained with reference to FIGS. 8 to 12. FIG. 8 is a flow chart which shows BET processing. FIG. 9 is a diagram showing the game portion 3 during betting, FIG. 10 is a diagram showing a betting image displayed on the dealer-used display 210, FIG. 11 is a diagram showing the game portion 3 five seconds after that the betting is started, and FIG. 12 is a diagram showing the bet end instructional image of the dealer-used display 210.

In Step S11, the CPU 81 sends a bet start signal to each station 4. When a bet start signal has been received, betting is made possible at each station 4.

Here, an appearance during betting is explained with reference to FIGS. 9 and 10.

In FIG. 9, no cards have been placed in the card placement areas 141 to 146. The in-bet image shown in FIG. 10 is displayed on a display area 210*a* of the dealer-used display 210.

In the display area 210*b*, an image for navigating the dealer that the "BET END" button (operation input button 214) must not be pressed, is displayed in a display area 210*b*. An image showing the result of a previous game is displayed on the display area 210*c*. A time in which betting is possible is displayed in the display area 210*d*.

Referring again to FIG. 8, the CPU 81 determines whether or not a predetermined period of time has elapsed in Step S12. More specifically, the CPU 81 starts measuring an elapsed time t with the timer 131, compares the elapsed time t with data indicating a predetermined time period T1 (e.g., 5 seconds) stored in the ROM 82, and determines whether the elapsed time t measured by the timer 131 has become the predetermined time period T1. In a case of this determination being NO, the CPU 81 returns the processing to Step S12, and in the case of being YES, advances the processing to Step S13.

In Step S13, the CPU 81 displays the bet end instructional image (refer to FIG. 12) in the display area 210*a* of the dealer-used display 210.

Here, an appearance during the betting is described with reference to FIGS. 11 and 12.

FIG. 11 is a view showing an appearance of the game portion 3 five seconds after the start of betting. According to FIG. 11, a card has not been placed on any of the card placement areas 141 to 146. The bet end instructional image, shown in FIG. 12, is displayed on the display area 210*a* of the dealer-used display 210.

FIG. 12 is a view showing the bet end instructional image, and the image for navigating the dealer that the "BET END" button (operation input button 214) should be pressed is displayed in the display area 210*b*. An image showing the result of a previous game is displayed on the display area 210*c*. A time in which betting is possible is displayed in the display area 210*d*.

Figure 18:
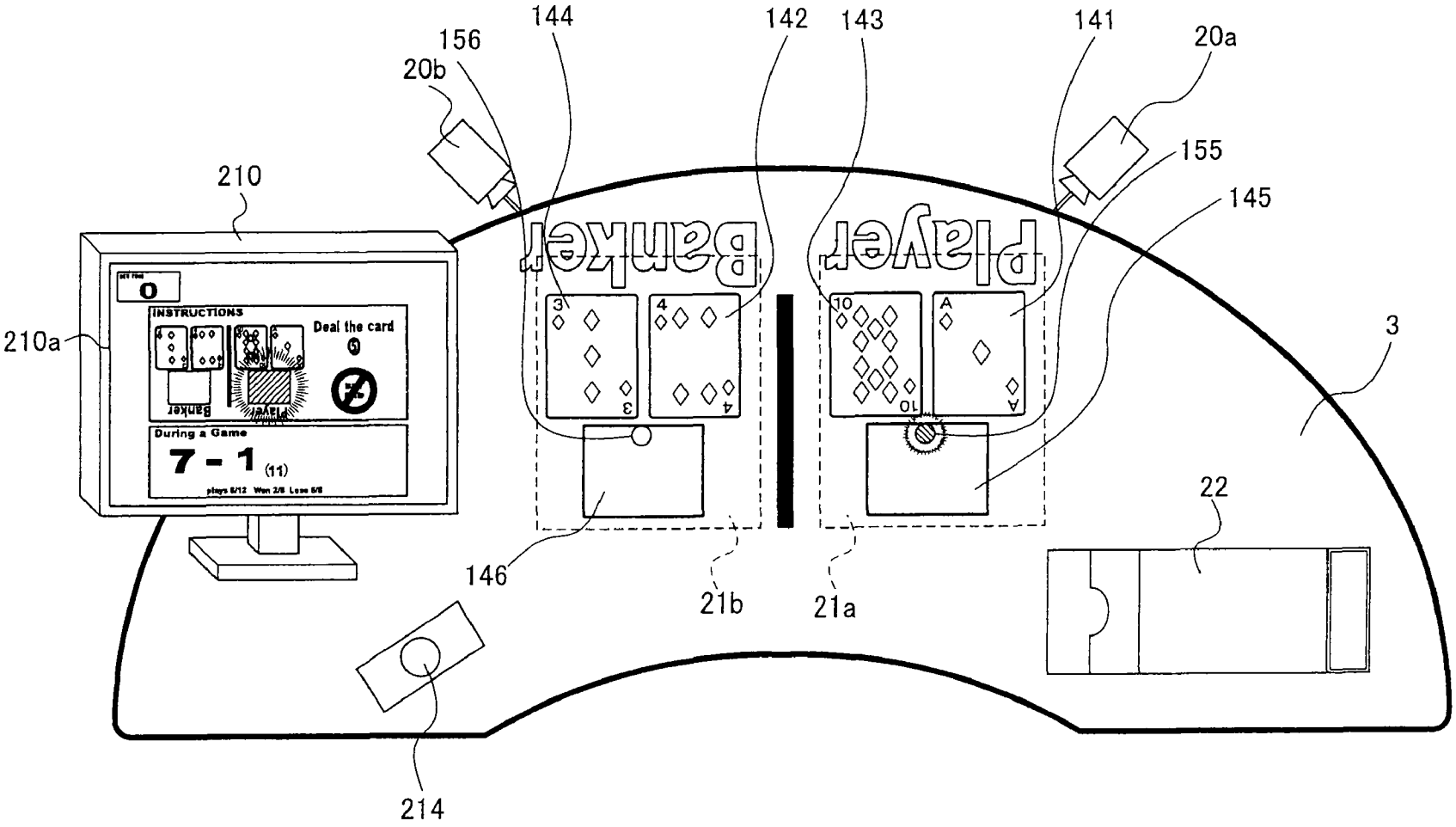
FIG. 18 is a view showing an appearance the game portion according to the embodiment of the present invention.

In Step S14 of FIG. 18, the CPU 81 determines whether or not the bet end instruction signal has been received from the operation input button 214. In the case of this determination being NO, the CPU 81 returns the processing to Step S14, and in the case of being YES, advances the processing to Step S15.

In Step S15, the CPU 81 sends a bet end signal to each station 4. When the bet end signal has been received at each station 4, betting becomes impossible, and the CPU 111 in the station control portion 110 displays an image (not illustrated) informing that acceptance of bets has ended on the image display device 7.

In Step S16, the CPU 81 receives BET information from each station 4. BET information is information related to a BET input performed at each station 4. In addition, information indicating whether a bet stored in a bet presence determination table (not illustrated) has been performed is also included in the BET information. When the processing of Step S16 ends, the CPU 81 ends bet processing.

Even if the dealer is inexperienced, an end operation for bet acceptance can be performed according to an instructional image by way of the bet processing of the present invention.

Figure 14:
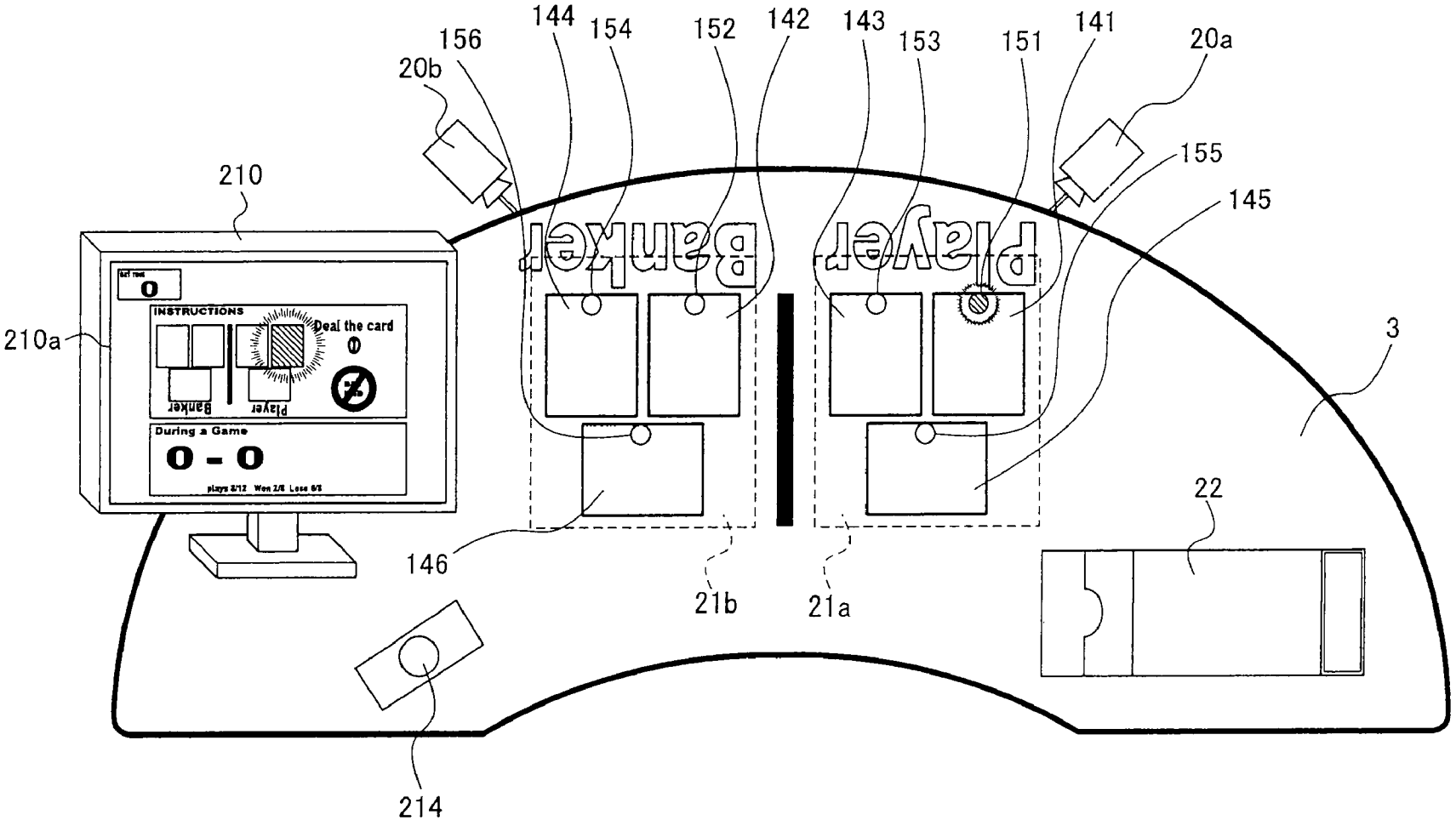
FIG. 14 is a view showing an appearance of the game portion according to the embodiment of the present invention.
Figure 15:
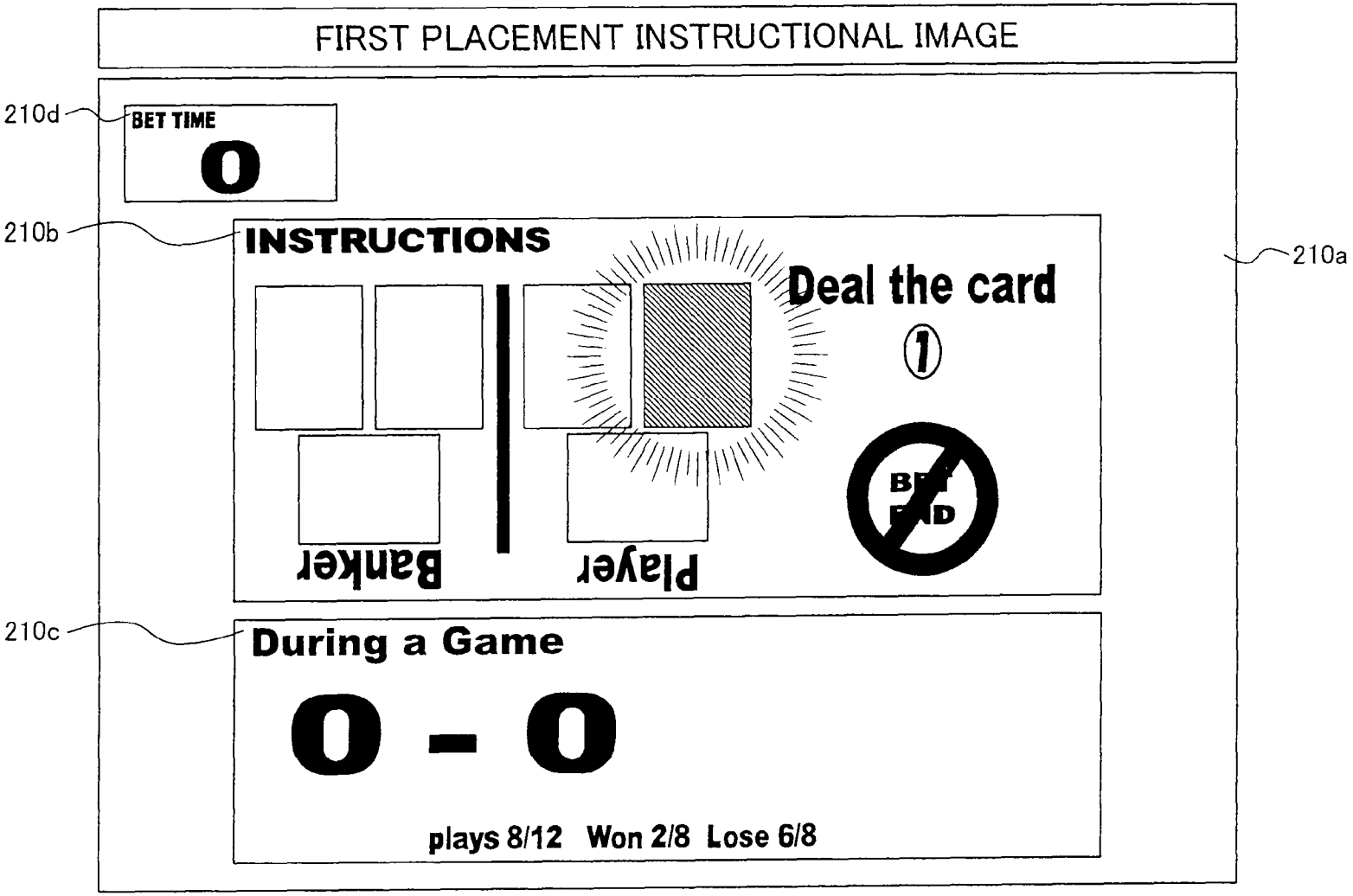
FIG. 15 is a view showing a display example of a dealer-used display according to the embodiment of the present invention.
Figure 16:
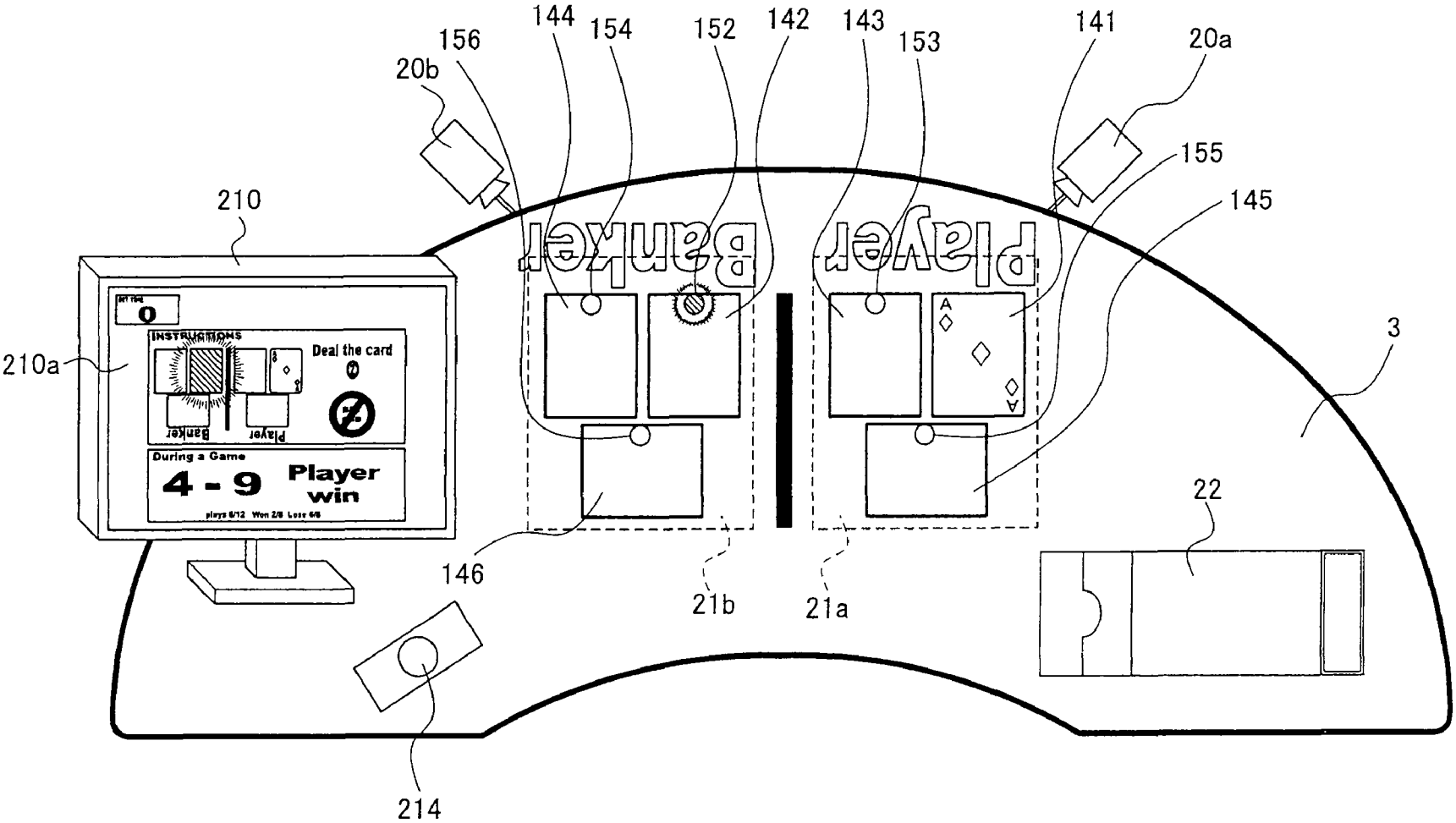
FIG. 16 is a view showing an appearance of the game portion according to the embodiment of the present invention.
Figure 17:
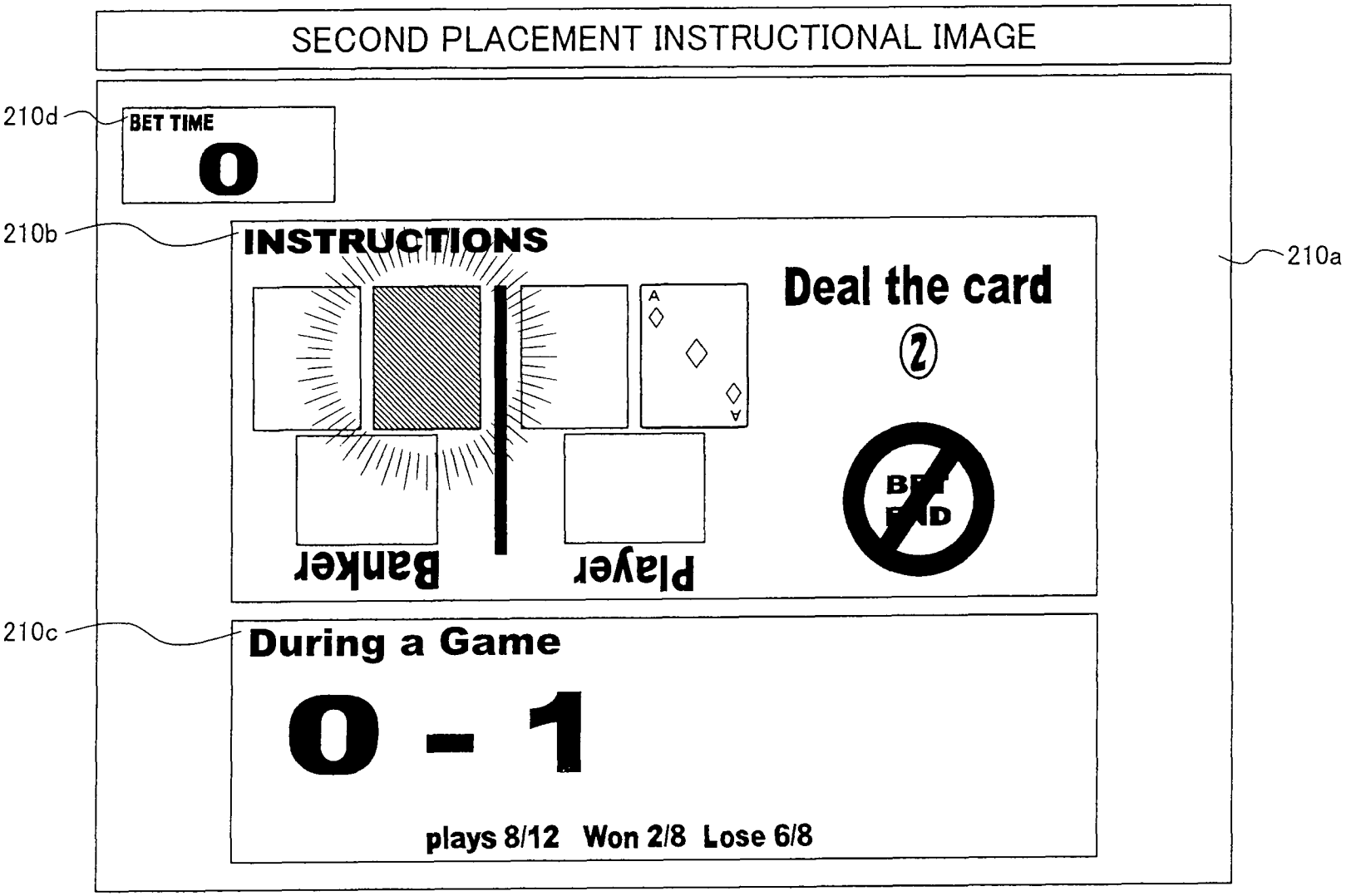
FIG. 17 is a view showing a display example of a dealer-used display according to the embodiment of the present invention.
Figure 19:
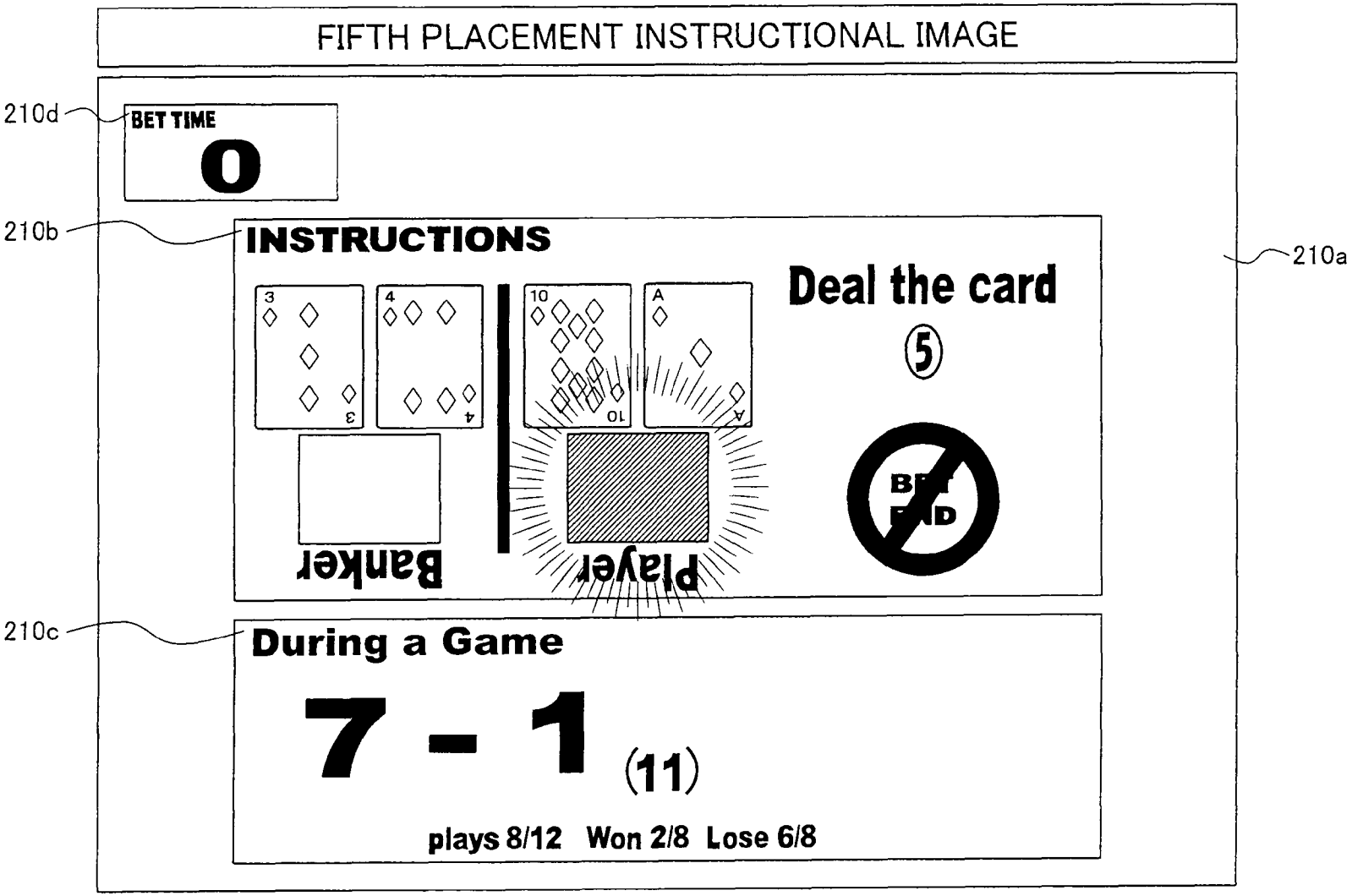
FIG. 19 is a view showing a display example of a dealer-used display according to the embodiment of the present invention.

The card placement navigation processing is explained with reference to FIGS. 13 to 19. FIG. 13 is a flowchart showing the card placement navigation processing. FIG. 14 is a view showing an appearance of the game portion 3 during placement of a first card in the card placement area 141. FIG. 15 is a view showing a first card placement instructional image displayed on the dealer-used display 210. FIG. 16 is a view showing an appearance of the game portion 3 during placement of a second card in the card placement area 144. FIG. 17 is a view showing a second card placement instructional image displayed on the dealer-used display 210. FIG. 18 is a view showing an appearance of the game portion 3 during placement of a fifth card in the card placement area 145. FIG. 19 is a view showing a fifth card placement instructional image displayed on the dealer-used display 210.

In Step S21, the CPU 81 sets a card number counter to 0. The card number counter is a counter for counting the number of cards read by the detection unit 222 of the card storage device 22, and is established in a predetermined memory area in the RAM 83.

Here, a relationship between the number of cards and the card placement areas 141 to 146 is explained.

A first card is placed on the card placement area 141 of the player side. A second card is placed in the card placement area 142 of the banker side. A third card is placed in the card placement area 143 of the player side. A fourth card is placed in the card placement area 144 of the banker side. A fifth card is placed in the card placement area 145 of the player side. A sixth card is placed in the card placement area 146 of the banker side.

In a Step S22, the CPU 81 increments the card number counter by 1.

In Step S23, the CPU 81 receives card information from the detection unit 222 of the card storage device 22. More specifically, the CPU 81 receives image data of a card read by the detection unit 222. The image data thus received is analyzed by the CPU 81 and a numeral or a symbol and a suit thereof are recognized. Information obtained by this analysis is stored in a predetermined memory area in the RAM 83 in a state of being associated with a value of the card number counter. As a result, recognized card information obtained by analyzing image data of a card read by the detection unit 222 is thus associated with a value of an order in which the card is read by the detection unit 222.

For example, in a case where a first card (a first card read by the detection unit 222 and a card placed in the card placement area 141) is 6 of diamonds, data 1, "diamonds, 6" is stored in a predetermined memory area of the RAM 83. In the same way, data of the card taken out from the card storage device 22 is stored.

In Step S24, the CPU 81 navigates a card placement area based on a value of the card number counter.

Here, an aspect of navigating the placement area of a first card is explained with reference to FIGS. 14 and 15.

FIG. 14 is a view showing an appearance of the game portion 3 while navigation of a placement area of a first card is being performed when the value of the card number counter is 1. According to FIG. 14, the lamp 151 provided at the card placement area 141 is illuminated in green. A first placement instructional image shown in FIG. 15 is displayed on the display area 210*a* of the dealer-used display 210.

In this way, the dealer can recognize that a card should be placed on the card placement area 141.

FIG. 15 is a view showing a first placement instructional image, and the image for navigating the dealer that the first card should be placed on the card placement area 141 is displayed in the display area 210*b*. According to this figure, the location corresponding to the card placement area 141 is shown to be illuminated in green. An image showing the result of a previous game is displayed on the display area 210*c*. The facts that the time in which betting is possible is 0, and that the betting period has ended are shown in the display area 210*d*.

In this way, the dealer can recognize that a card should be placed on the card placement area 141 also by looking at the display area 210*b*.

Furthermore, an aspect of navigating the placement area of a second card is explained with reference to FIGS. 16 and 17.

FIG. 16 is a view showing an appearance of the game portion 3 while navigation of a placement area of the second card is being performed when the value of the card number counter is 2. According to FIG. 16, the first card is placed on the card placement area 141, and the lamp 152 provided at the card placement area 142 is illuminated in green. According to FIG. 17, the first card is placed on the card placement area 141, and the lamp 152 provided at the card placement area 142 is illuminated in green.

In this way, the dealer can recognize that the card should be placed on the card placement area 142.

FIG. 17 is a view showing a second placement instructional image, and the image for navigating the dealer that the second card should be placed on the card placement area 142 is displayed in the display area 210*b*. According to this figure, a location corresponding to the card placement area 142 is shown to be illuminated in green. In the display area 210*c*, an image showing a current score is displayed. An Ace of diamonds is placed on the player side and no card is placed on the banker side, and thus a score "0-1" is displayed.

Here, the score is calculated based on rules of the game executed in the gaming system 1. More specifically, the score is calculated based on the game advancement program stored in the ROM 82. In the present embodiment, the gaming system 1 is a system for executing a baccarat game. Accordingly, based on the game advancement program, Ace is 1 point, face cards (J, Q and K) are each 10 points, and the other cards (2 to 9) are 2 to 9 points, respectively. The banker side or the player side having cards placed in the respective card placement areas 141 to 146 having a total is closer to 9, is the winner. It should be noted that, in a case where the total exceeds 10, the tens digit is not used in the score.

The facts that the time in which betting is possible is 0, and that the betting period has ended are shown in the display area 210*d*.

In this way, the dealer can recognize that the card should be placed on the card placement area 142 also by looking at the display area 210*b*.

It should be noted that the method of navigating a placement area of the third, fourth and sixth cards is similar to the method shown in FIGS. 14 to 17.

Referring again to FIG. 13, the CPU 81 performs verification/warning processing in Step S25. The warning processing is described later with reference to FIG. 18.

In Step S26, the CPU 81 determines whether the value of the card number counter is six. In the case of this determination being YES, the CPU 81 ends card placement navigation processing, and in the case of being NO, advances the processing to Step S27.

In Step S27, it is determined whether the value of the card number counter is five. In the case of this determination being YES, the CPU 81 advances the processing to Step S30, and in the case of being NO, advances the processing to Step S28.

In Step S28, it is determined whether the value of the card number counter is four. In the case of this determination being YES, the CPU 81 advances the processing to Step S29, and in the case of being NO, advances the processing to Step S22.

In Step S29, the CPU 81 determines whether a third card of the player side has been placed. In the case of this determination being YES, the CPU 81 advances the processing to Step S22, and in the case of being NO, ends card placement navigation processing. More specifically, the CPU 81 determines whether the third card of the player side has been placed based on information of the first to fourth cards (first of the player side, first of the banker side, second of the player side, and second of the banker side), stored in a predetermined memory area of the RAM 83.

Here, an aspect of navigating the placement area in the case of placing a third card on the player side is explained with reference to FIGS. 18 and 19.

FIG. 18 is a view showing an appearance of the game portion 3 while navigation of a placement area of a third card of the player side (a fifth card in total) is being performed when the value of the card number counter is 1. According to FIG. 18, the lamp 155 provided at the card placement area 145 is illuminated in green. A fifth placement instructional image shown in FIG. 19 is displayed on the display area 210*a* of the dealer-used display 210.

In this way, the dealer can recognize that a card should be placed on the card placement area 145.

FIG. 19 is a view showing a fifth placement instructional image, and the image for navigating the dealer that the fifth card should be placed on the card placement area 145 is displayed in the display area 210*b*. According to this figure, the location corresponding to the card placement area 141 is shown to be illuminated in green. In the display area 210*c*, a current score is displayed. The score of the player side is "1 (11)", and the score of the banker side is 7. "1 (11)" means that the score is 1 and the total value of the card is "11". Cards of 1 and 10 are placed in the card placement areas 141 and 143 on the player side, thus making the total "11". However, due to being 10 or greater, only the ones digit thereof, 1, is the score.

The facts that the time in which betting is possible is 0, and that the betting period has ended are shown in the display area 210*d*.

In this way, the dealer can recognize that the card should be placed on the card placement area 141 also by looking at the display area 210*b*.

In Step S30, the CPU 81 determines whether the third card of the banker side has been placed. In the case of this determination being YES, the CPU 81 advances the processing to Step S22, and in the case of being NO, ends card placement navigation processing. More specifically, the CPU 81 determines whether the third card of the banker side has been placed based on information of the first to fifth cards (first of the player side, first of the banker side, second of the player side, second of the banker side, third of the player side), stored in a predetermined memory area of the RAM 83.

Figure 20:
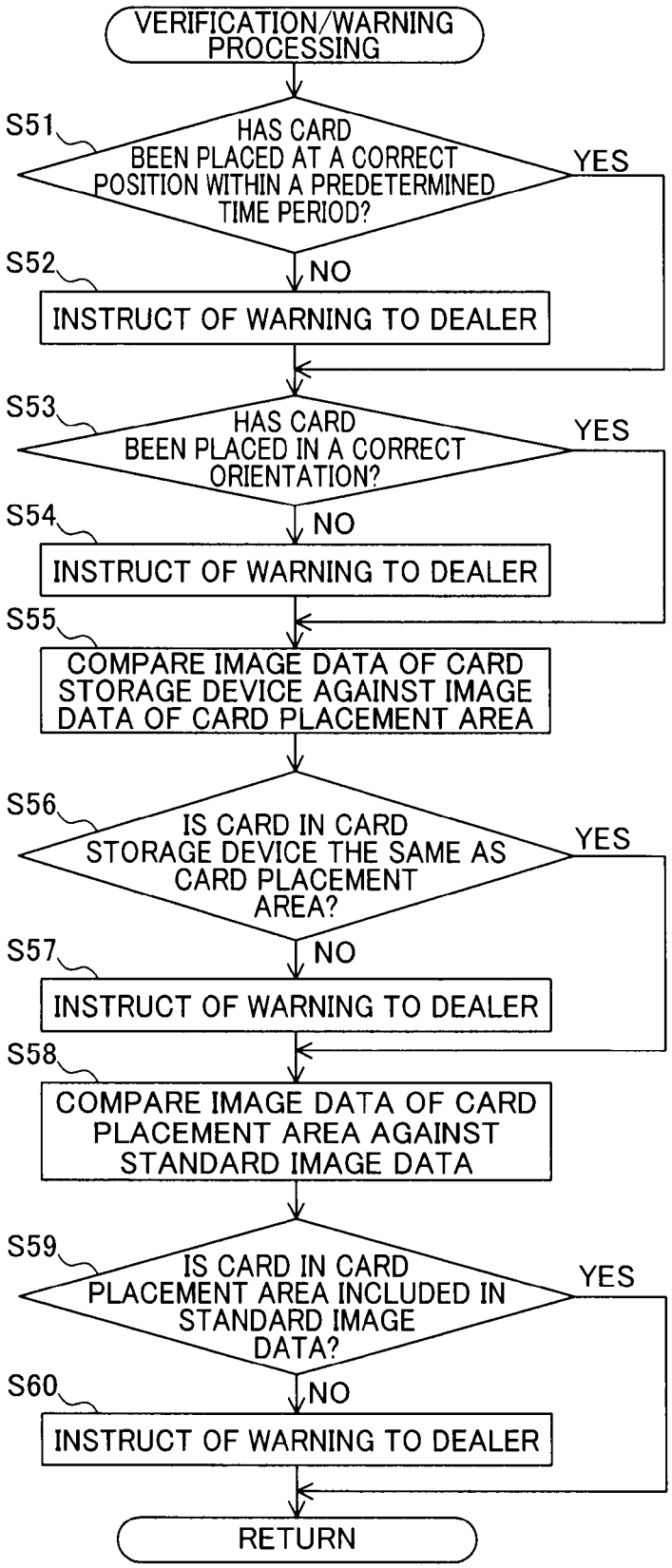
FIG. 20 is a flowchart of verification/warning processing according to the embodiment of the present invention.
Figure 21:
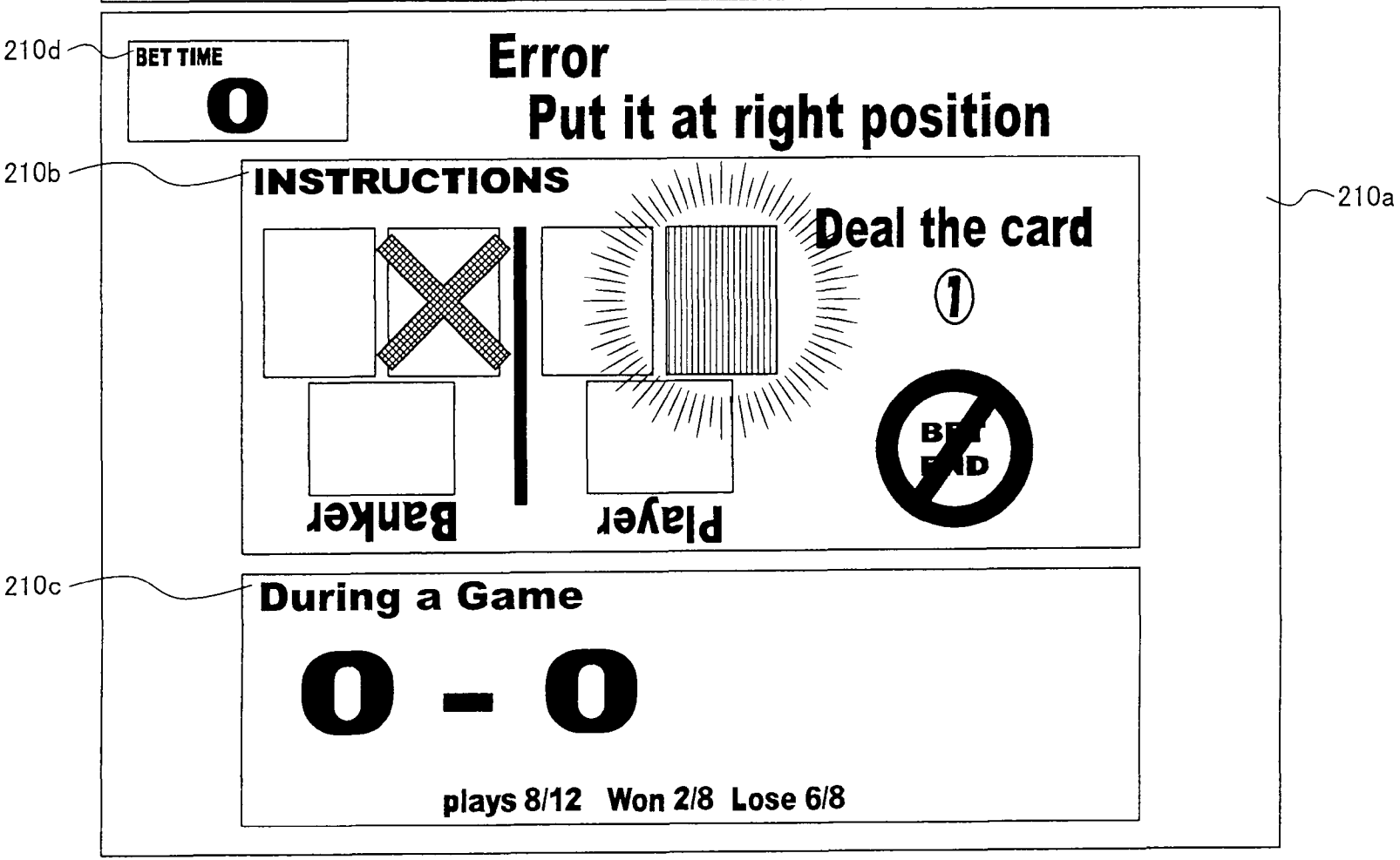
FIG. 21 is a view showing a display example of a dealer-used display according to the embodiment of the present invention.
Figure 22:
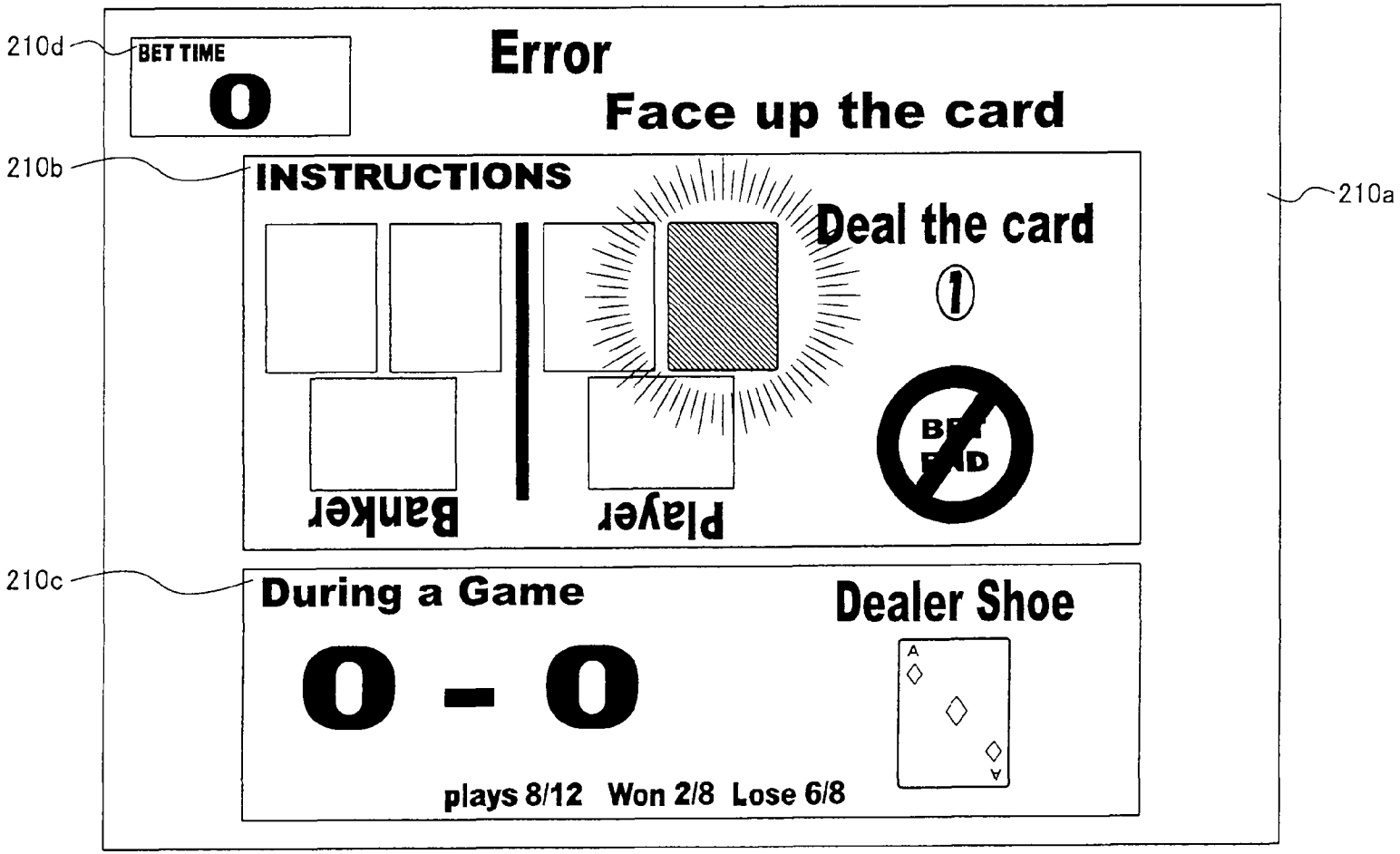
FIG. 22 is a view showing a display example of a dealer-used display according to the embodiment of the present invention.
Figure 23:
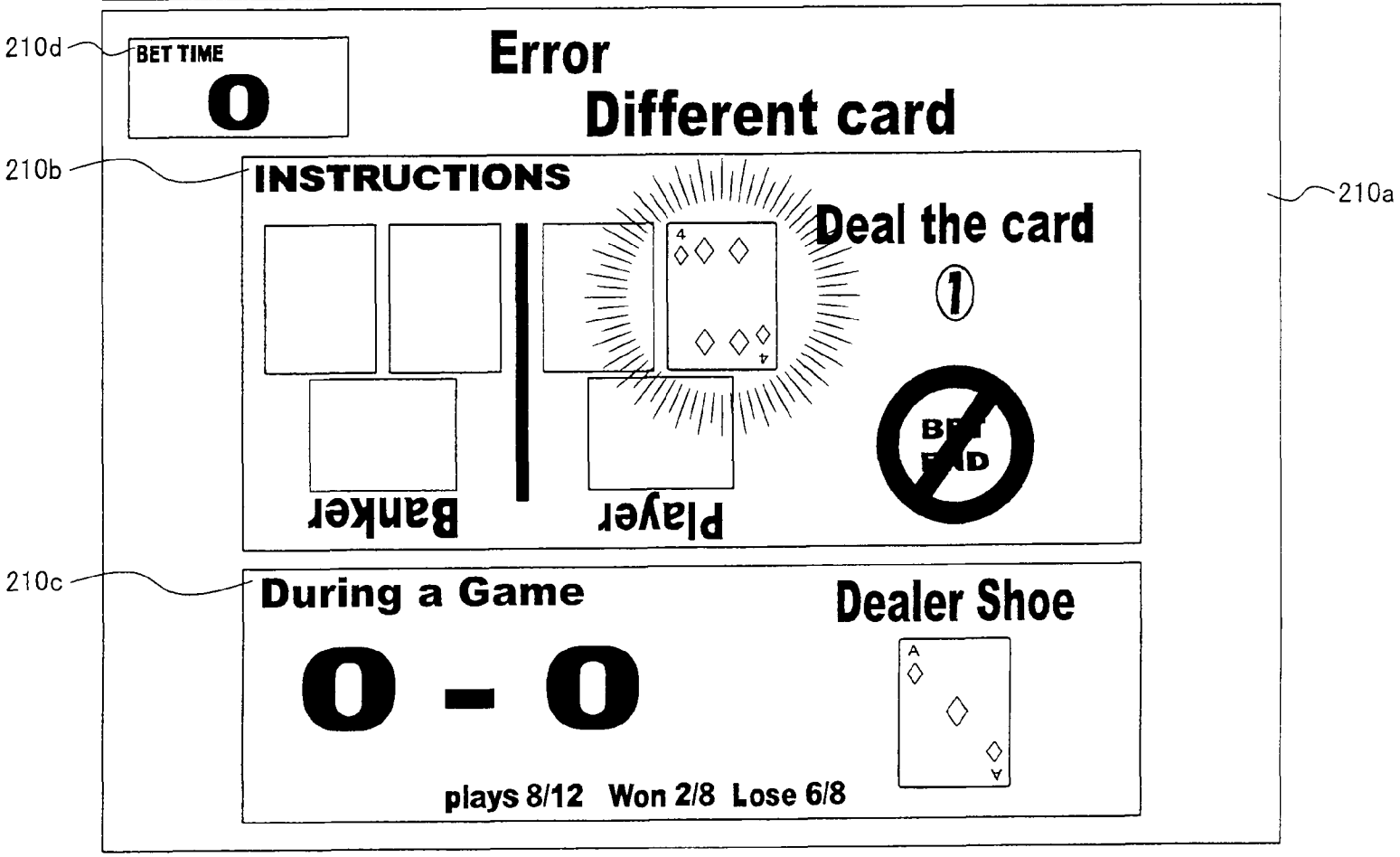
FIG. 23 is a view showing a display example of a dealer-used display according to the embodiment of the present invention.

Warning processing is explained with reference to FIGS. 20 to 23. FIG. 20 is a flowchart showing the warning processing. FIG. 21 is a view showing an instructional image warning of an incorrect position of a card being placed, FIG. 22 is a view showing an instructional image warning of incorrect orientation of the card being placed, and FIG. 23 is an instructional image warning of an incorrect card being placed.

In Step S51, the CPU 81 receives image data from the cameras 20*a* and 20*b*, and determines whether or not a card is placed at a correct position within a predetermined period of time. More specifically, the CPU 81 determines whether or not a card is placed at a position designated by the game advancement program based on the game advancement program stored in the ROM 82 and the image data received from the cameras 20*a* and 20*b*. Even more specifically, the CPU 81 compares the image data thus received against image data captured prior to the beginning of the game, and in a case where the image data thus received is different from the image data captured prior to the beginning of the game and an image representing the card is present at a position designated by the game advancement program, the CPU 81 determines that a card is placed. In the case of a YES determination, the CPU 81 advances the processing to Step S53, and in a case of a NO determination, advances the processing to Step S52.

In Step S52, the CPU 81 performs warning notification to a dealer. More specifically, the CPU 81 displays a warning of an incorrect position of the card on the dealer-used display 210. Placing the first card is described as an example. In this case, since the value of the card number counter is 1, a card is to be placed in the card placement area 141. Accordingly, the CPU 81 illuminates the lamp 151, which corresponds to the card placement area 141, in red. In this way, even in a case where the first card has not been placed on the card placement area 141 within the predetermined time period, by changing from green and illuminating the lamp in red, the dealer can understand that a card must be placed on the card placement area 141. In a case of the value of the card number counter being 2 to 6, one of the lamps 152 to 156 is illuminated in red. It should be noted that it is not limited to being illuminated in red, and may be configured so as to blink in red.

Here, an aspect of performing warning notification of a placement area of the first card is explained with reference to FIG. 21.

FIG. 21 is a view showing a first card placement warning image. In the display area 210*a*, a warning of an incorrect position of the card is displayed. An image notifying a warning to the dealer that the first card should be placed in the card placement area 141 is displayed in the display area 210*b*. According to this figure, the location corresponding to the card placement area 141 is shown to be illuminated in red. In addition, "X" is displayed in the card placement area 143. This indicates that a card is not to be placed in the card placement area 143 since an image representing a card is present in the card placement area 143. An image showing the result of a previous game is displayed on the display area 210*c*. The facts that the time in which betting is possible is 0, and that the betting period has ended are shown in the display area 210*d*.

Here, for example, in a case where no cards have been placed at all, the warning displayed in the display area 210*a* can indicate that no cards have been placed at all, or that a card is to be placed in the card placement area 141.

Referring again to FIG. 20, the CPU 81 determines whether or not a card is placed in a correct orientation in Step S53. More specifically, the CPU 81 determines whether or not an upper face of the card is a correct face, based on the game advancement program stored in the ROM 82 and the image data received from the cameras 20*a* and 20*b*. In the present embodiment, all the cards are to be placed such that an obverse face thereof is directed upward. Therefore, the CPU 81 determines whether a face on which a numeral or a symbol of the card is marked is included in the image data. Alternatively, determination of whether or not a reverse face of the card is included in the image data received from the scanners 21*a* and 21*b* can be made.

In a case where the card is determined to be placed in a correct orientation, the CPU 81 advances to Step S55, and in a case where the card is determined not to be placed in a correct orientation, the CPU 81 advances to Step S54.

In Step S54, the CPU 81 displays a warning on the dealer-used display 210. More specifically, as shown in FIG. 22, a warning indicating that, for example, a card must be placed face-up is displayed in the display area 210*a*, and the corresponding card display area (in FIG. 22, the card display area 141) is illuminated in red. In addition, in the display area 210*c*, a card recognized based on the image data received from the detection unit 222 of the card storage device 22 is displayed along with the current score.

In Step S55 in FIG. 20, the CPU 81 compares the image data submitted from the detection unit 222 of the card storage device 22 against image data of a state where a card is placed in one of the card placement areas 141 to 146. More specifically, the CPU 81 analyzes the image data submitted from the detection unit 222 and recognizes a numeral or a symbol and a suit of the card. Then, the CPU 81 recognizes a numeral or a symbol and a suit of the card placed in the image data of the state where a card is placed in the one of the card placement areas 141 to 146. Thereafter, the CPU 81 compares a card taken out from the card storage device 22 against the card placed in the one of the card placement areas 141 to 146.

In Step S56, the CPU 81 determines whether or not the card taken out from the card storage device 22 is the same as the card placed in the one of the card placement areas 141 to 146. More specifically, the CPU 81 determines whether or not the two cards recognized in Step S53 are the same. In a case where the two pieces of image data include the same card, the CPU 81 advances to Step S58, and in a case where the two pieces of image data do not include the same card, the CPU 81 advances to Step S57.

In Step S57, the CPU 81 notifies of a warning to a dealer. More specifically, the CPU 81 displays on the dealer-used display 210 a warning indicating that the card taken out from the card storage device 22 is different from the card placed in the one of the card placement areas 141 to 146.

The warning display displayed on the dealer-used display 210 in Step S57 is explained hereinafter with reference to FIG. 23. The warning display shown in FIG. 23 shows a case in which a warning has been performed during placement of a first card. In the display area 210*a*, a message indicating that the cards are different is displayed above the display area 210*b*. In addition, in the display area 210*b*, an image warning a dealer that the first card should be placed in the card placement area 141. This diagram shows that a location corresponding to the card placement area 141 is illuminated in red and the card placed in the area is the 4 of diamonds. Since placement of the card has started, the present game is in progress. Therefore, in the display area 210*c*, an image showing a current score is displayed. In addition, beside the image showing the score, card information detected by the detection unit 222 of the card storage device 22 is displayed. FIG. 23 shows that the card recognized by the detection unit 222 is the Ace of diamonds. As a result, the dealer can recognize that the card recognized by the detection unit 222 is different from the card being placed.

Referring again to FIG. 20, in Step S58, the CPU 81 compares image data of a card being newly placed in one of the card placement areas 141 to 146 against the standard image data. More specifically, the CPU 81 compares an image of a card being newly placed in the one of the card placement areas 141 to 146 included in the image data being received, against the standard image data of the card stored in the RAM 83.

Particularly, the CPU 81 recognizes image data received from the scanners 21*a* and 21*b*. In the present embodiment, since the card is placed face-up, the scanners 21*a* and 21*b* capture image data of a reverse face of the card, and sends the image data to the control unit 2. First, the CPU 81 compares the reverse face of the card against the standard image data. A pattern on the reverse face of the card is the same for all the cards in a deck, and different between decks. Therefore, by identifying the pattern on the reverse face of the card, data for the obverse face thereof can be retrieved.

Next, the CPU 81 retrieves the standard image data for the obverse face of the card from the RAM 83, and determines whether or not the image representing the card recognized in Step S57 shows the same card as the standard image data. The standard image data for the obverse face of the card is stored in the RAM 83 for all cards included in a deck. Therefore, the CPU 81 determines whether or not the same card is represented, by comparing the standard image data for the obverse face retrieved by identifying the reverse face against the image representing the card recognized in Step S57.

In a case where the card recognized in Step S57 is included in a plurality of pieces of standard image data, the CPU 81 terminates the verification/warning processing, and in a case where the card is not included therein, the CPU 81 advances to Step S60.

In Step S60, the CPU 81 displays a warning indicating that a card that is different from the standard image data is placed. In this warning, a similar image to the warning display shown in FIG. 23 is displayed on the dealer-used display 210. Although an image in this warning is different from the image indicating that a different card is placed displayed in the display area 210*a* of FIG. 23, in this case, the image indicates that a card not included in the standard image data is placed. In addition, in the display area 210*b*, an area corresponding to the card placement area 141 in which the card is placed (in FIG. 23, a position corresponding to the card placement area 141) is illuminated in red. When this processing ends, the CPU 81 ends the verification/warning processing.

Figure 24:
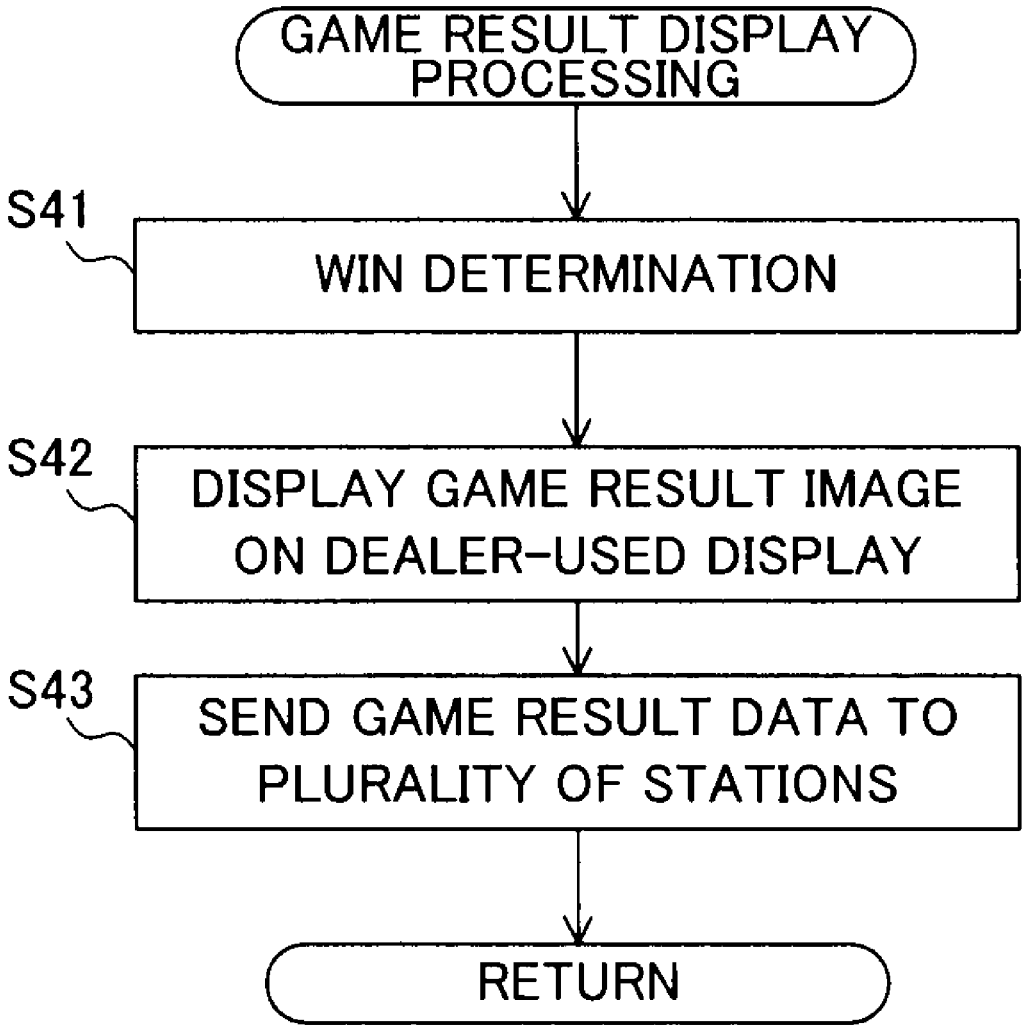
FIG. 24 is a flowchart showing game result display processing according to the embodiment of the present invention.
Figure 25:
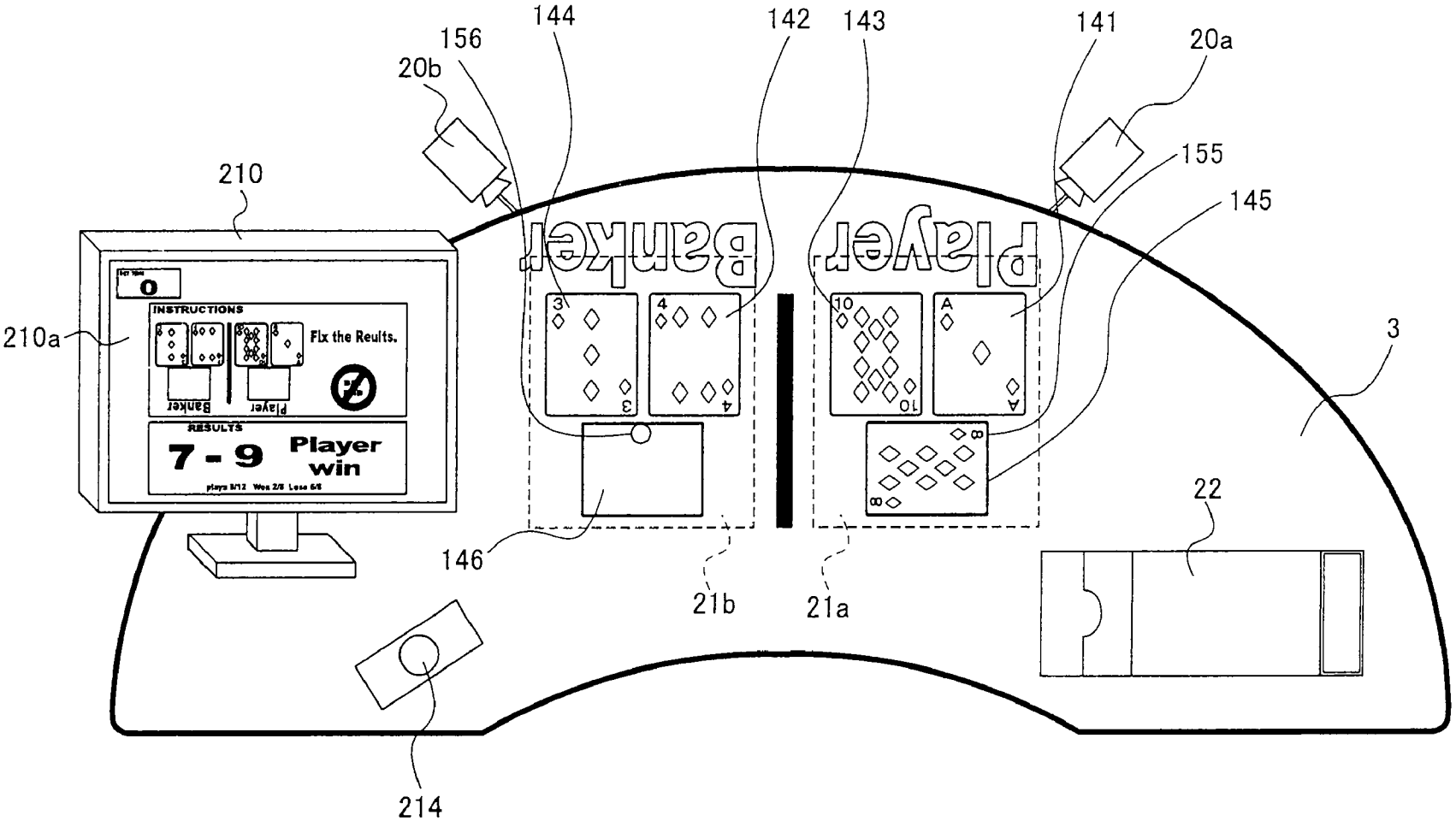
FIG. 25 is a view showing an appearance of the game portion according to the embodiment of the present invention.
Figure 26:
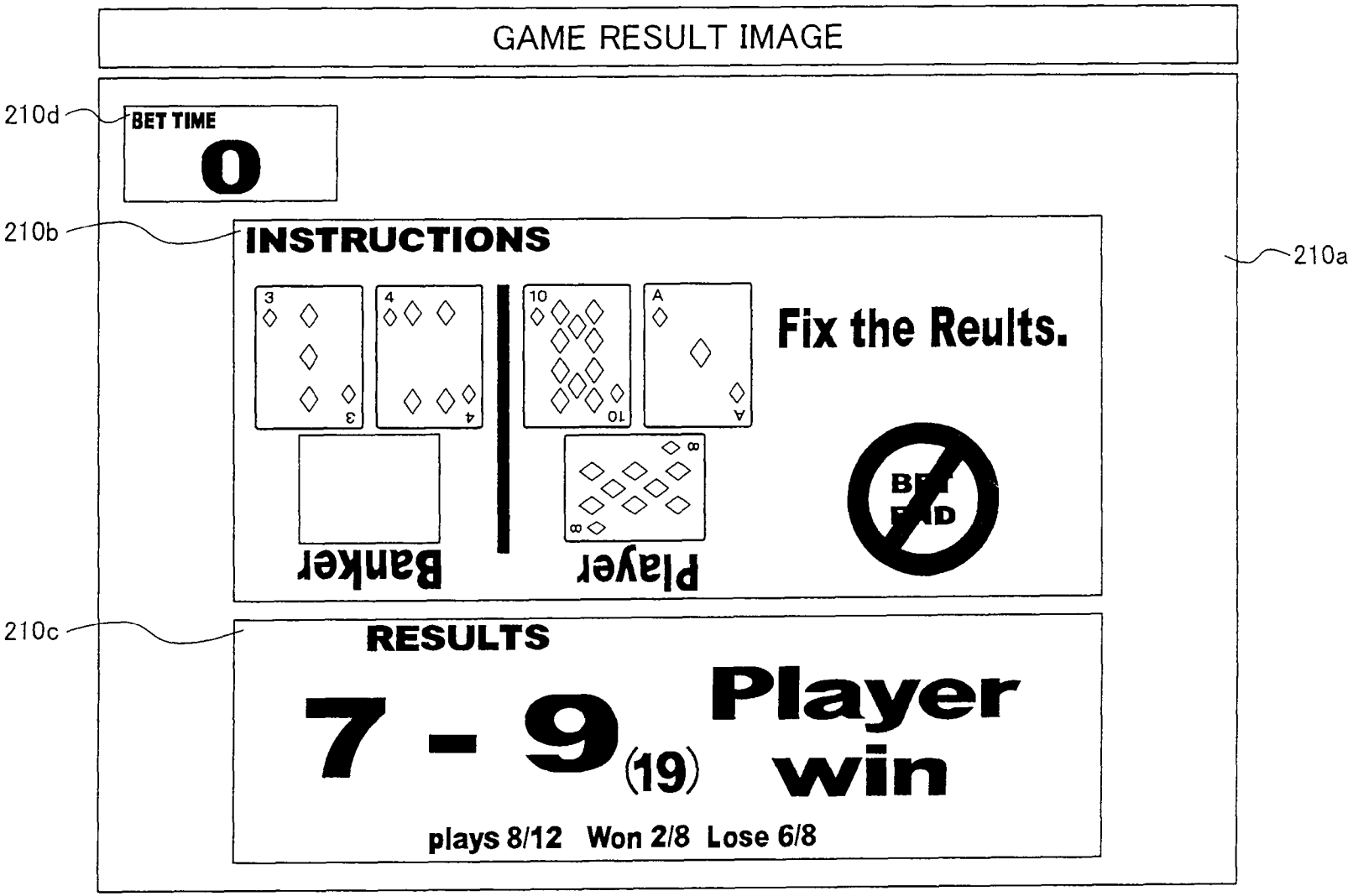
FIG. 26 is a view showing a display example of a dealer-used display according to the embodiment of the present invention.

The game result display processing is explained hereinafter with reference to FIGS. 24 to 26. FIG. 24 is a flowchart showing the game result display processing. FIG. 25 is a view showing an appearance of the game portion 3 at a point when winning/losing in a baccarat game has been determined. FIG. 26 is a diagram showing the game result image.

In Step S41, the CPU 81 performs win determination. More specifically, the CPU 81 determines a win based on information of cards placed on the player side and the banker side.

The result of win determination (game result) is any of "Player (player position" win, "Banker (banker position)" win, or "Tie (draw)".

In Step S42, the CPU 81 displays a picture of the game result on the dealer-used display. More specifically, the CPU 81 displays a picture of the game result shown in FIG. 26 on the dealer-used display 210.

Here, an aspect at a point when a baccarat game outcome has been determined is explained with reference to FIGS. 25 and 26.

Figure 13:
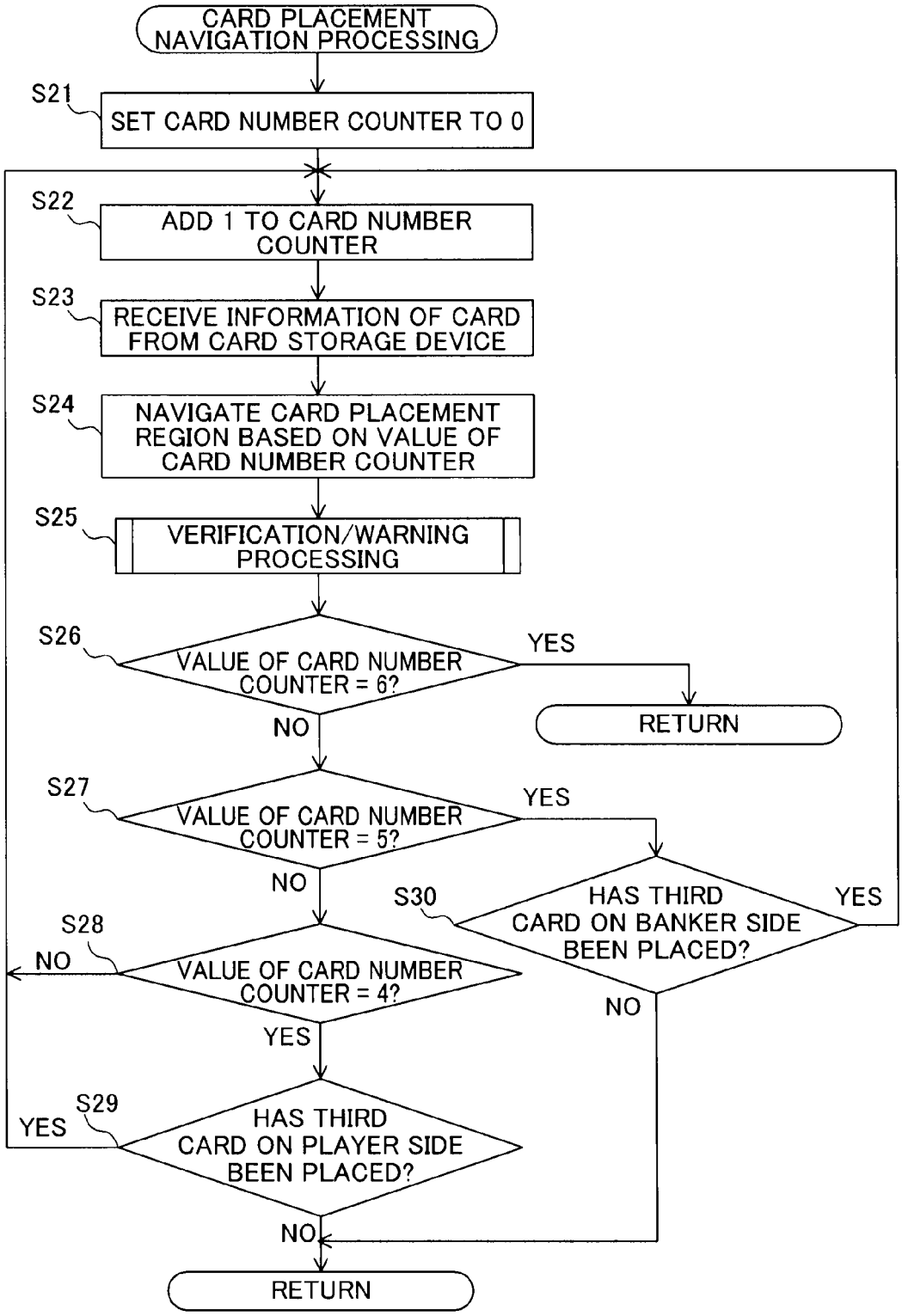
FIG. 13 is a flowchart of card placement navigation processing according to the embodiment of the present invention.

FIG. 25 is a view showing the game portion 3 at the point when winning/losing in a baccarat game has been determined in Step S41 in FIG. 24, after the card placement advancement processing shown in FIG. 13 is ended. According to FIG. 25, four cards are respectively placed on the card placement areas 141 to 144. The game result image shown in FIG. 26 is displayed on the display area 210*a* of the dealer-used display 210.

FIG. 26 is a view showing a game result image, and the image for navigating the dealer that the "BET END" button (operation input button 214) should not be pressed since the game results have been settled is displayed in the display area 210*b*. An image showing the results of a current game is displayed in the display area 210*c*. The facts that the time in which betting is possible is 0, and that the betting period has ended are shown in the display area 210*d*. In Step S43 of FIG. 24, the CPU 81 sends data of the game result to the plurality of stations. More specifically, the CPU 81 sends data of the game result (e.g., data indicating the player side wins by 6 to 9) to each of the stations 4. Furthermore, on the stations 4 having received data of this game result, the CPU ill in the station control portion 110 displays a picture of the game result via the liquid crystal drive circuit 120 on the image display device 7, based on the data of this game result. Moreover, the CPU 111 performs payout based on a bet amount. These allow for a picture of the game result to be displayed on each station 4 while payout is being performed based on a bet amount. When the processing of Step S43 has ended, the CPU 81 ends the game result display processing.

Figure 27:
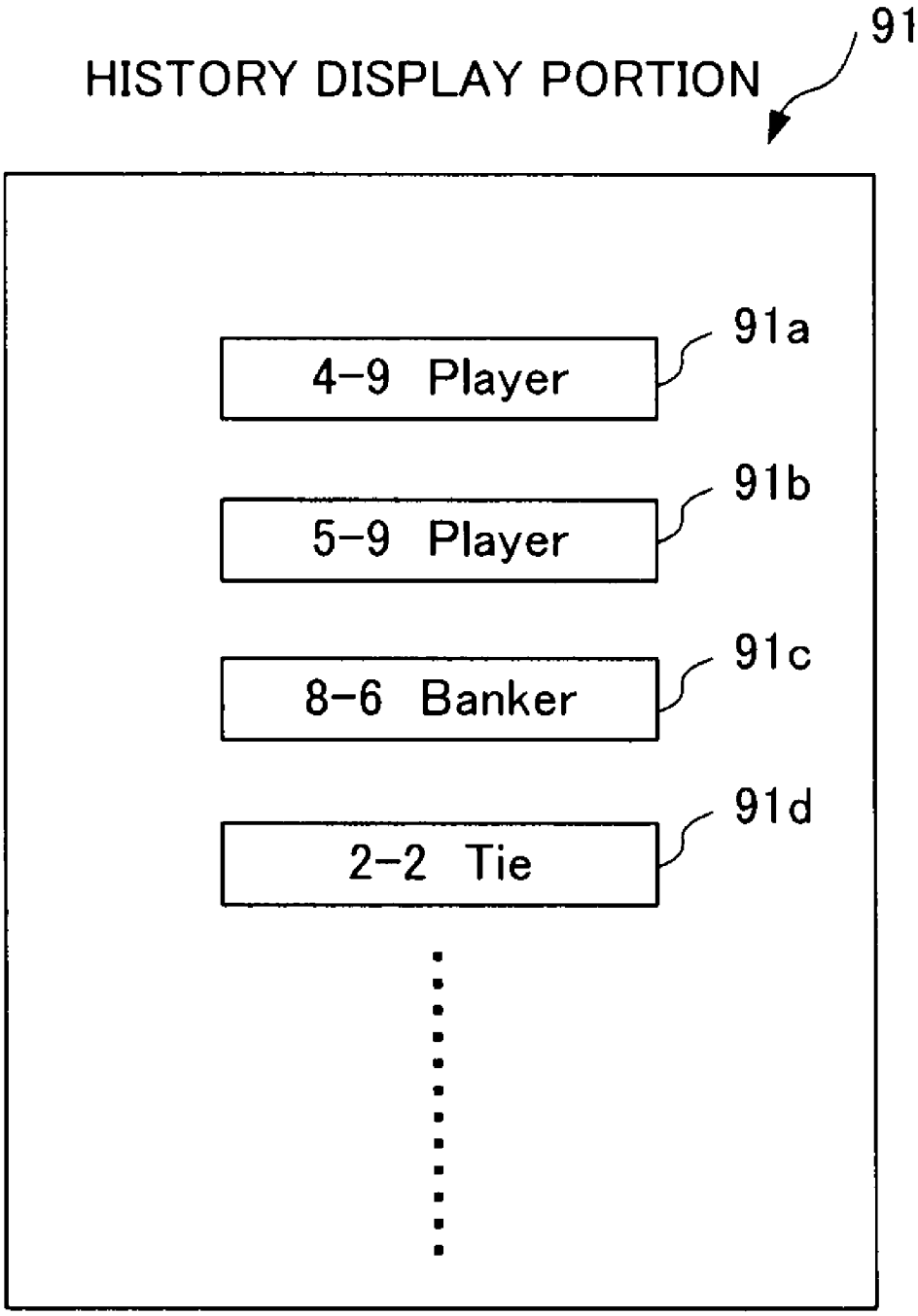
FIG. 27 is a view showing a display example of a display screen of a history display portion according to the embodiment of the present invention.

Display of the history display portion 91 is described with reference to FIG. 27. FIG. 27 is a view showing an example of a picture displayed by display screen of the history display portion.

Display areas 91*a*, 91*b*, 91*c*, 91*d* . . . for displaying game history are established on the display screen of the history display 91. The game result of a game one prior to the current game is displayed in the display area 91*a*. The game result of games two prior, three prior, four prior . . . to the current game are displayed in the display areas 91*b*, 91*c*, 91*d* . . . , respectively.

The player side having won by 4 to 9 is shown as the display contents of the display area 91*a*. The player side having won by 5 to 9 is shown as the display contents of the display area 91*b*. The banker side having won by 8 to 6 is shown as the display contents of the display area 91*c*. There being a tie of 2 to 2 is shown as the display contents of the display area 91*d*.

It should be noted that a plurality of LED luminous bodies (not illustrated) are disposed around the history display portion 91, and this plurality of LED luminous bodies emit light in various lighting states according to game advancement and the like. An explanation of the present embodiment has been provided above. Although an explanation has been provided for the case of a baccarat game, the present invention is not limited thereto, and may be a card game such as poker or black jack, and may be a game other than a card game, for example, a dice game such as SICBO, or a roulette game.

In the present embodiment, although an instruction was made to a dealer so that an operation input button 214 is operated by displaying a bet end instructional image on the display area 210*a* of the dealer-used display 210, it is not limited thereto, and a lamp may be provided at a location visible to the dealer (e.g., on the game portion 3 or the like) as an instructional device and instruction may be performed by illumination of the lamp, an LED luminous body may be provided in an operation input button 214 as an instructional device and instructions may be performed by illumination of the LED luminous body, or a device may be provided on the operation input button 214 as an instructional device that causes a physical change to occur in the button (e.g., raises the button).

In particular, in SICBO or roulette, it is not necessary to output at instruction for the placement location of a card to the dealer, and game advancement is possible with only an operation input button; therefore, installation of a display can be omitted.

The present embodiment is configured so that live pictures are displayed on the large external monitor 500; however, it is not limited thereto, and it may be configured so as to display on each station 4. In this way, even in a case where a player cannot easily see the game portion 3 due to the positional relationship of the station 4 and the game portion 3, the player can look at the live picture on the station 4.

In the present embodiment, a case is explained in which the controller of the present invention is configured with a CPU 81 provided to the main control portion 80 and the CPU 111 provided to the station 4; however, the controller of the present invention may be configured with only one CPU.

Although an embodiment of the present invention has been explained above, it is merely exemplified as a specific example, and the present invention is not particularly limited thereto; specific configurations of each means and the like can be suitably modified in design. In addition, the effects described in the embodiment of the present invention are merely listed as the most preferred effects arising from the present invention, and the effects according to the present invention are not limited to those described in the embodiment of the present invention.

What is claimed is:

1. A gaming system for executing a card game, the gaming system comprising:

a plurality of stations;

a control unit that transmits and receives information relating to a game with the plurality of stations, and controls advancement of the game;

a game portion that has a flat surface and has a plurality of card placement areas, a card used for the card game being placed on each of the plurality of card placement areas, the plurality of card placement areas constituting a required number of opposing groups for determining winning or losing of the game, and each of the opposing groups including two or more card placement areas among the plurality of card placement areas;

and an image input device that captures an image of at least one side of the card being placed on any of the plurality of card placement areas, and that transmits image data thus captured to the control unit, wherein the game portion includes a plurality of indicators that correspond to the plurality of card placement areas, respectively, each of the plurality of indicators being associated with only one of the plurality of card placement areas, and wherein the control unit includes an instructional device that gives an instruction relating to advancement of the game to a dealer, first memory that stores a game advancement program relating to the advancement of the game, and a controller that executes processing of:

(a) activating the indicator that corresponds to a card placement area on which a current card is to be placed among the plurality of card placement areas, based on the game advancement program;

(b) receiving the image data that is captured by the image input device;

(c) calculating a score represented by the current card based on the image data;

(d) determining whether to further place a next card in any of the plurality of card placement areas based on the score calculated in the processing of (c);

(e) activating the indicator that corresponds to a card placement area in which the next card is to be placed among the plurality of card placement areas based on the game advancement program, in a case where it is determined to further place the card in the processing of (d);

(f) repeating the processing of (b) to (e) for a predetermined number of times and determining winning or losing of the game in a case where it is determined not to further place the card in the processing of (d); and (g) displaying a result of the game on the instructional device based on the processing of (f).

2. A gaming system for executing a card game, the gaming system comprising:

a plurality of stations;

a control unit that transmits and receives information relating to a game with the plurality of stations, and controls advancement of the game;

a game portion that has a flat surface and has a plurality of card placement areas, a card used for the card game being placed on each of the plurality of card placement areas, the plurality of card placement areas constituting a required number of opposing groups for determining winning or losing of the game, and each of the opposing groups including two or more card placement areas among the plurality of card placement areas; and an image input device that captures an image of an upper side and a lower side of the card being placed on any of the plurality of card placement areas and transmits image data thus captured to the control unit, wherein the game portion includes a plurality of indicators that correspond to the plurality of card placement areas, respectively, each of the plurality of indicators being associated with only one of the plurality of card placement areas, and wherein the control unit includes an instructional device that gives an instruction relating to the advancement of the game to a dealer, first memory that stores a game advancement program relating to the advancement of the game, second memory that stores a plurality of pieces of standard image data that represent an obverse face on which a numeral or a symbol of the card is shown and a reverse face on which a numeral or a symbol of the card is not shown, and a controller that executes processing of:

(a) activating the indicator that corresponds to a card placement area on which a current card is to be placed among the plurality of card placement areas, based on the game advancement program;

(b) receiving the image data that is captured by the image input device;

(c) determining whether standard image data representing the current card is present or not, by comparing the image data received in the processing of (b) with a plurality of pieces of standard image data stored in the second memory;

(d) calculating a score represented by the current card based on the image data, in a case where it is determined that the standard image data representing the card is present in the processing of (c);

(e) displaying information on the instructional device, in a case where it is determined that the standard image data representing the current card is not present in the processing of (c);

(f) determining whether to further place a next card in any of the plurality of card placement areas based on the score calculated in the processing of (d);

(g) activating the indicator that corresponds to a card placement area in which the next card is to be placed among the plurality of card placement areas based on the game advancement program, in a case where it is determined to further place the card in the processing of (f);

(h) repeating the processing of (b) to (g) for a predetermined number of times and determining winning or losing of the game in a case where it is determined not to further place the card in the processing of (f); and (i) displaying a result of the game on the instructional device based on the processing of (h).

3. The gaming system according to claim 2, wherein the plurality of pieces of standard image data is stored in the second memory for each group of cards used for the game.

4. The gaming system according to claim 2, wherein:

wherein the plurality of pieces of standard image data is stored in the second memory for each group of cards used for the game, the standard image data of the obverse face is stored in the second memory for each numeral or each symbol of the card, and the standard image data of the reverse face includes one set of standard image data that is stored in the second memory, for each group of cards.

5. A gaming system for executing a card game, the gaming system comprising:

a plurality of stations;

a control unit that transmits and receives information relating to a game with the plurality of stations and controls advancement of the game;

a game portion that has a flat surface and has a plurality of card placement areas, a card used for the card game being placed on each of the plurality of card placement areas, the plurality of card placement areas constituting a required number of opposing groups for determining winning or losing of the game, and each of the opposing groups including two or more card placement areas among the plurality of card placement areas; and an image input device that captures an image of at least one side of the card being placed on any of the plurality of card placement areas and transmits image data thus captured to the control unit, wherein the game portion includes a plurality of indicators that correspond to the plurality of card placement areas, respectively, each of the plurality of indicators being associated with only one of the plurality of card placement areas; and wherein the control unit includes an instructional device that gives an instruction relating to the advancement of the game to a dealer, first memory that stores a game advancement program relating to the advancement of the game, second memory that stores a plurality of pieces of standard image data that represent an obverse face on which a numeral or a symbol of the card is shown and a reverse face on which a numeral or a symbol of the card is not shown, and a controller that executes:

(a) activating the indicator that corresponds to a card placement area on which a current card is to be placed among the plurality of card placement areas, based on the game advancement program;

(b) receiving the image data that is captured by the image input device;

(c) determining whether or not a face of the current card represented by the image data is a face to be placed on the card placement area in the game advancement program;

(d) displaying information on the instructional device, in a case where it is determined that a face of the current card represented by the image data is not a face to be placed on the card placement area in the game advancement program in the processing of (c);

(e) calculating a score represented by the current card based on the image data, in a case where it is determined that a face of the current card represented by the image data is a face to be placed on the card placement area in the game advancement program in the processing of (c);

(f) determining whether a next card is to be further placed in any of the plurality of card placement areas based on the score calculated in the processing of (e);

(g) activating the indicator that corresponds to a card placement area in which the next card is to be placed among the plurality of card placement areas based on the game advancement program, in a case where it is determined that the card is to be further placed in the processing of (f);

(h) repeating the processes (b) to (g) for a predetermined number of times and determining winning or losing of the game in a case where it is determined that the card is not to be further placed in the processing of (f); and (i) displaying a result of the game on the instruction device based on the processing of (h).

6. The gaming system according to claim 5, wherein the plurality of pieces of standard image data is stored in the second memory for each group of cards used for the game.

7. The gaming system according to claim 5, wherein the plurality of pieces of standard image data is stored in the second memory for each group of cards used for the game, the standard image data of the obverse face is stored in the second memory for each numeral or each symbol of the card; and the standard image data of the reverse face includes one set of standard image data that is stored in the second memory, for each group of cards.

8. A gaming system for executing a card game, the gaming system comprising:

a plurality of stations;

a control unit that transmits and receives information relating to a game with the plurality of stations, and controls advancement of the game;

a game portion that has a flat surface and has a plurality of card placement areas, a card used for the card game being placed on each of the plurality of card placement areas, and the plurality of card placement areas constituting a required number of opposing groups for determining winning or losing of the game, and each of the opposing groups including two or more card placement areas among the plurality of card placement areas; and an image input device that captures an image of an upper side and a lower side of the card being placed on any of the plurality of card placement areas and transmits image data thus captured to the control unit, wherein the game portion includes a plurality of indicators that correspond to the plurality of card placement areas, respectively, each of the plurality of indicators being associated with only one of the plurality of card placement areas; and the control unit includes an instructional device that gives an instruction relating to the advancement of the game to a dealer, first memory that stores a game advancement program relating to the advancement of the game, second memory that stores a plurality of pieces of standard image data that represent an obverse face on which a numeral or a symbol of the card is shown and a reverse face on which a numeral or a symbol of the card is not shown, and a controller that executes processing of:

(a) activating the indicator that corresponds to a card placement area on which a current card is to be placed among the plurality of card placement areas, based on the game advancement program;

(b) receiving the image data that is captured by the image input device;

(c) determining whether a face of the current card represented by the image data is a face to be placed on the card placement area in the game advancement program;

(d) displaying information on the instructional device, in a case where it is determined that a face of the current card represented by the image data is not a face to be placed on the card placement area in the game advancement program in the processing of (c);

(e) determining whether standard image data representing the current card is present or not, by comparing the image data received in the processing of (b) with a plurality of pieces of standard image data stored in the second memory;

(f) displaying information on the instructional device, in a case where it is determined that the standard image data representing the current card is not present in the processing of (e);

(g) calculating a score represented by the current card based on the image data, in a case where it is determined that the standard image data representing the current card is present in the processing of (e);

(h) determining whether to further place a next card in any of the plurality of card placement areas based on the score calculated in the processing of (g);

(i) activating the indicator that corresponds to a card placement area in which the next card is to be placed among the plurality of card placement areas based on the game advancement program, in a case where it is determined to further place the next card in the processing of (h);

(j) repeating the processing of (b) to (i) for a predetermined number of times and determining winning or losing of the game in a case where it is determined not to further place the card in the processing of (h); and (k) displaying a result of the game on the instructional device based on the processing of (j).

9. The gaming system according to claim 8, wherein the plurality of pieces of standard image data is stored in the second memory for each group of cards used for the game.

10. The gaming system according to claim 8, wherein the plurality of pieces of standard image data is stored in the second memory for each group of cards used for the game, the standard image data of the obverse face is stored in the second memory for each numeral or each symbol of the card; and the standard image data of the reverse face includes one set of standard image data that is stored in the second memory, for each group of cards.

* * * * *